US011008747B2

(12) United States Patent
Abbas et al.

(10) Patent No.: US 11,008,747 B2
(45) Date of Patent: May 18, 2021

(54) MANHOLE AND SEWER NETWORK

(71) Applicant: LIVERPOOL JOHN MOORES UNIVERSITY, Liverpool (GB)

(72) Inventors: Alaa Henou Abbas, Liverpool (GB); Rafid Al-Khaddar, Liverpool (GB); Felicite Ruddock, Liverpool (GB)

(73) Assignee: LIVERPOOL JOHN MOORES UNIVERSITY, Liverpool (GB)

( * ) Notice: Subject to any disclaimer, the term of this patent is extended or adjusted under 35 U.S.C. 154(b) by 0 days.

(21) Appl. No.: 16/615,000

(22) PCT Filed: May 22, 2018

(86) PCT No.: PCT/GB2018/051375

§ 371 (c)(1),
(2) Date: Nov. 19, 2019

(87) PCT Pub. No.: WO2018/215746

PCT Pub. Date: Nov. 29, 2018

(65) Prior Publication Data

US 2020/0232201 A1 Jul. 23, 2020

(30) Foreign Application Priority Data

May 23, 2017 (GB) ..... 1708254

(51) Int. Cl.
*E03F 5/02* (2006.01)
*E03F 3/06* (2006.01)

(52) U.S. Cl.
CPC ..... *E03F 5/022* (2013.01); *E03F 3/06* (2013.01)

(58) Field of Classification Search
CPC .... E03F 5/022; E03F 5/02; E03F 3/02; E02D 29/12; B65D 81/3227

(Continued)

(56) References Cited

U.S. PATENT DOCUMENTS 4,882,046 A * 11/1989 Waite ..... C02F 3/1242 210/195.3
2012/0132295 A1* 5/2012 Zook ..... C02F 3/288 137/409
2016/0348351 A1* 12/2016 Johnsen ..... F16K 31/22

FOREIGN PATENT DOCUMENTS

BE 1019456 A3 7/2012
DE 29623294 U1 2/1998

(Continued)

OTHER PUBLICATIONS

International Searching Authority, International Search Report and Written Opinion for International Application No. PCT/GB2018/051375, dated Sep. 10, 2018, (12 pages), Rijswijk, The Netherlands.

*Primary Examiner* — Sean D Andrish
(74) *Attorney, Agent, or Firm* — Alston & Bird LLP

(57) ABSTRACT

A manhole (100) for subterranean installation is described. The manhole (100) comprises a first chamber (110) arranged to receive storm water and a second chamber (120) arranged to receive sewage water. The first chamber (110) comprises a first inlet (111) and a first outlet (112). The second chamber (120) comprises a second inlet (121) and a second outlet (122). The first chamber (110) comprises a first access port (113) opposed to a first base (114) and a first wall (115) arranged therebetween. The second chamber (120) comprises a second access port (123) opposed to a second base (124) and a second wall (125) arranged therebetween. A first normal N1 to the first base (114) extends through the first base (114) and the second base (124). A sewer network 1000 and a method of installing the sewer network are also described.

20 Claims, 29 Drawing Sheets

(58) Field of Classification Search
USPC ..... 220/506
See application file for complete search history.

(56) References Cited

FOREIGN PATENT DOCUMENTS

| | | | | |
|---|---|---|---|---|
| DE | 19642176 | | * | 4/1998 |
| DE | 202014000333 | U1 | | 7/2014 |
| EP | 0736636 | A1 | | 10/1996 |
| WO | WO-1991/014052 | A1 | | 9/1991 |
| WO | WO-2014/014231 | A1 | | 1/2014 |

* cited by examiner

ODB: 60.odb Abaqus/Standard 3DEXPERIENCE R2016x Fri Nov 11 20:58:27 GMT Standard Time 2016
Step: CellLoad
Increment 25: Step Time = 1.000
Primary Var: U, Magnitude
Deformed Var: U Deformation Scale Factor: +1.000e+00

ODB: 60.odb Abaqus/Standard 3DEXPERIENCE R2016x Fri Nov 11 20:58:27 GMT Standard Time 2016
Step: CellLoad
Increment 25: Step Time = 1.000
Primary Var: U, Magnitude
Deformed Var: U Deformation Scale Factor: +1.000e+00

MANHOLE AND SEWER NETWORK

CROSS REFERENCE TO RELATED APPLICATIONS

This application is a National Stage Application, filed under 35 U.S.C. § 371, of International Application No. PCT/GB2018/051375, filed May 22, 2018, which international application claims priority to Great Britain Application No. 1708254.6, filed May 23, 2017; the contents of both of which as are hereby incorporated by reference in their entireties.

BACKGROUND

Related Field

The present invention relates to manholes, sewer networks comprising manholes and methods of installing such manholes and sewer networks.

Description of Related Art

Typically, sewer networks are used to transport sewage water (also known as sanitary, foul or waste water) to treatment plants. The sewage water is treated at the treatment plants before discharge to, for example, watercourses such as rivers or lakes. The sewer networks may also be used to transport storm water (also known as rain or runoff water) to the watercourses, for example, discharged into the watercourses. In an event of mixing of the sewage water and the transport water, such mixed water may be transported to the treatment plants and/or the watercourses. Such mixed water may increase capacity requirements of the treatments plants, due to an increased volume compared with unmixed sewage water. Due to the sewage water, such mixed water may contaminate the watercourses if discharged therein, adversely affecting the environment and/or public health.

The sewer networks typically comprise subterranean pipes, through which water is transported, and manholes. The manholes allow inspection and/or maintenance of the sewer networks, such as the pipes, and typically couple sections of the pipes. Manholes may also be known as utility holes, maintenance holes, inspection chambers, access chambers, sewer holes, or confined spaces. The manholes are typically subterranean, accessible via access ports, for example, from roads or pavements. Manhole covers are typically provided to cover the access ports.

Conventional combined sewer networks transport such mixed water through common pipes and manholes and thus may be associated with lower costs and/or reduced installation requirements, such as installation costs, installation footprints and/or installation times. The storm water may better transport sedimentation from the sewage water deposited in the common pipes. These combined sewer networks make up about 70% of the sewer networks in the UK and many EU countries. The treatment plants for these combined sewer networks typically have capacities around three times greater than for dry weather sewage water, to provide additional capacity for wet weather storm water. However, in an event of flow rates exceeding the capacities of the treatment plants, excess mixed water may be diverted without treatment, for example by combined sewer overflows (CSOs), to the watercourses.

Separate sewer networks transport sewage water and storm water separately through different pipes and manholes and thus better avoid mixing of the sewage water and storm water. Thus, the capacity requirements of the treatments plants may be reduced compared with the combined sewer networks while diversion of sewage water by CSOs is avoided. In this way, contamination of the watercourses is avoided.

New regulations, in the UK for example, may require installation of the separate sewer networks in new construction developments. Typically, regulations worldwide permit installation of the conventional combined sewer networks only as limited extensions to, or replacements of, existing conventional combined sewer networks. However, installation costs and/or requirements of the separate sewer networks may be higher compared with the combined sewer networks since installation of different pipes is required. Furthermore, installation of the separate sewer networks in narrow streets, for example, may be challenging due to space constraints.

Hence, there is a need to improve sewer networks.

BRIEF SUMMARY

It is one aim of the present invention, amongst others, to provide a manhole which at least partially obviates or mitigates at least some of the disadvantages of the prior art, whether identified herein or elsewhere. For instance, it is an aim of embodiments of the invention to provide a manhole that may maintain sewage water and storm water separately, thereby better avoid mixing of the sewage water and storm water. For instance, it is an aim of embodiments of the invention to provide a sewer network comprising a manhole associated with lower costs and/or reduced installation requirements compared with conventional separate sewer networks.

A first aspect of the invention provides a manhole for subterranean installation, the manhole comprising a first chamber arranged to receive storm water and a second chamber arranged to receive sewage water;

wherein the first chamber comprises a first inlet and a first outlet;

wherein the second chamber comprises a second inlet and a second outlet;

wherein the first chamber comprises a first access port opposed to a first base and a first wall arranged therebetween;

wherein the second chamber comprises a second access port opposed to a second base and a second wall arranged therebetween; and wherein a first normal to the first base extends through the first base and the second base.

A second aspect of the invention provides a sewer network for storm water and for sewage water, the network comprising a first manhole according to the first aspect, a second manhole according to the first aspect, and a first pipe and a second pipe extending therebetween;

wherein the first pipe is coupled to the first outlet of the first manhole and to the first inlet of the second manhole; and wherein the second pipe is coupled to the second outlet of the first manhole and to the second inlet of the second manhole;

wherein the first pipe and the second pipe are superposed for at least a part of their respective lengths.

A third aspect of the invention provides a method of installing a sewer network according to the second aspect, the method comprising:

providing an excavation arranged to receive the first manhole, the second manhole and the first pipe and the second pipe extending therebetween;

arranging the first manhole, the second manhole and the first pipe and the second pipe extending therebetween in the excavation;

coupling the first pipe to the first outlet of the first manhole and to the first inlet of the second manhole;

coupling the second pipe to the second outlet of the first manhole and to the second inlet of the second manhole;

wherein the first pipe and the second pipe are superposed for at least the part of their respective lengths; and backfilling the excavation.

Throughout this specification, the term "comprising" or "comprises" means including the component(s) specified but not to the exclusion of the presence of other components. The term "consisting essentially of" or "consists essentially of" means including the components specified but excluding other components except for materials present as impurities, unavoidable materials present as a result of processes used to provide the components, and components added for a purpose other than achieving the technical effect of the invention, such as colourants, and the like.

The term "consisting of" or "consists of" means including the components specified but excluding other components.

Whenever appropriate, depending upon the context, the use of the term "comprises" or "comprising" may also be taken to include the meaning "consists essentially of" or "consisting essentially of", and also may also be taken to include the meaning "consists of" or "consisting of".

The optional features set out herein may be used either individually or in combination with each other where appropriate and particularly in the combinations as set out in the accompanying claims. The optional features for each aspect or exemplary embodiment of the invention, as set out herein are also applicable to all other aspects or exemplary embodiments of the invention, where appropriate. In other words, the skilled person reading this specification should consider the optional features for each aspect or exemplary embodiment of the invention as interchangeable and combinable between different aspects and exemplary embodiments.

The first aspect provides a manhole for subterranean installation, the manhole comprising a first chamber arranged to receive storm water and a second chamber arranged to receive sewage water;

wherein the first chamber comprises a first inlet and a first outlet;

wherein the second chamber comprises a second inlet and a second outlet;

wherein the first chamber comprises a first access port opposed to a first base and a first wall arranged therebetween;

wherein the second chamber comprises a second access port opposed to a second base and a second wall arranged therebetween; and wherein a first normal to the first base extends through the first base and the second base.

In this way, the sewage water and the storm water may be maintained separate, thereby better avoid mixing of the sewage water and storm water. In this way, the capacity requirements of the treatments plants may be reduced compared with conventional combined sewer networks while diversion of sewage water by CSOs is avoided. In this way, contamination of the watercourses is avoided.

Since the sewage water and the storm water may be maintained separate in the same manhole, the manhole and/networks comprising the manhole be associated with lower costs and/or reduced installation requirements compared with conventional separate sewer networks. For example, the manhole may be provided in place of two conventional manholes, as required in conventional separate sewer networks.

Since the manhole comprises the first chamber and the second chamber, a structural property of the manhole may be increased compared with conventional manholes. For example, a strength, a load-bearing capacity and/or a resistance to settling of the manhole may be increased. In this way, longevity and/or vehicle capacity of the manhole may be increased.

Conversely, a material requirement of the manhole may be reduced compared with conventional manholes, while maintaining the structural property of conventional manholes. For example, a material strength and/or a wall thickness may be reduced. In this way, cost and/or complexity of the manhole may be lowered.

In addition, the manhole and/networks comprising the manhole will have economic benefits, from decreasing the cost of construction of separate sewer systems, as described below in more detail. For example, this design allows installation of two separate pipes (storm pipe and sanitary pipe, respectively) in one trench, one above over the other. Further, the manhole and/networks comprising the manhole make it possible to install a separate sewer system in areas where it is difficult to install conventional separate system, as it saves the footprint of the sewer line and decreases the time for installation of pipe lines, especially in the UK and EU. Furthermore, the manhole and/networks comprising the manhole may enhance the structure and hydraulic properties of the separate sewer system and increase the storage capacity and retention time for storm water, which will mitigate flooding risk and improve the quality of the effluent entering watercourses.

The manhole is for subterranean installation, for example, in the ground or soil under a thoroughfare, road or pavement.

The first chamber is arranged to receive the storm water and comprises the first inlet and the first outlet. That is, the first outlet is in fluid communication with the first inlet via the first chamber. The storm water may be received into the first chamber via the first inlet. The storm water may be discharged from the first chamber via the first outlet.

The second chamber is arranged to receive the sewage water and comprises the second inlet and the second outlet. That is, the second outlet is in fluid communication with the second inlet via the second chamber. The sewage water may be received into the second chamber via the second inlet. The sewage water may be discharged from the second chamber via the second outlet.

The storm chamber (i.e. the first chamber) may be bigger than the sewage chamber (i.e. the second chamber), and the first inlet and/or the first outlet may be sized to accept different pipe diameters and/or larger pipe diameters. Typically, pipes in a storm system increase in size in a direction downstream in the network because a quantity of storm water increases rapidly when a concentration time of a storm (i.e the time that storm water needs to reach the inlet of the network from a surface road, for example) is short. In contrast, sewage flow is typically more stable and may be calculated depending on a number of properties and/or a population density in an area served by the network. Therefore, pipes diameters required for sewage water are smaller than pipes required for storm water and any increase in size downstream in the network is more gradual.

In one example, the first inlet is arranged to couple to a first inlet pipe. In one example, the first outlet is arranged to couple to a first outlet pipe. In one example, the second inlet is arranged to couple to a second inlet pipe. In one example, the second outlet is arranged to couple to a second outlet pipe. Pipes such as the first inlet pipe, the first outlet pipe, the second inlet pipe and/or the second outlet pipe may be provided in standard sizes and/or arranged to couple by standard means, as known in the art, according to a purpose i.e. transport of the waste water and/or transport of the sewage water via the pipes.

It should be understood that the first chamber and the second chamber may be interchangeable. That is, the first chamber may be arranged to receive sewage water and the second chamber may be arranged to receive waste water. Additionally and/or alternatively, the first chamber and the second chamber may be arranged to receive storm water. Additionally and/or alternatively, the first chamber and the second chamber may be arranged to receive sewage water.

It should be understood that the first inlet and the first outlet may be interchangeable. It should be understood that the second inlet and the second outlet may be interchangeable.

The first chamber comprises the first access port. In this way, access to the first chamber for inspection and/or maintenance may be provided via the first access port. In use, the first access port may be arranged substantially coplanar with a surface of the ground, as for conventional manholes. Thus, in use, the first access port may be arranged above the first base. For example, the first access port may be arranged uppermost and the first base lowermost.

The second chamber comprises the second access port. In this way, access to the second chamber for inspection and/or maintenance may be provided via the second access port. In use, the second access port may be arranged substantially coplanar with a surface of the ground, as for conventional manholes. Thus, in use, the second access port may be arranged above the second base. For example, the second access port may be arranged uppermost and the second base lowermost.

The first base may comprise a planar portion. In this way, manufacturing and/or installation may be facilitated and/or costs reduced. The first base may comprise a non-planar portion. The first base may comprise a curved portion, for example a domed, dished and/or hemispherical portion. In this way, strength such as to internal and/or external loading may be increased. The first base may comprise a concave portion and/or a convex portion. The first base may comprise no internal corners and/or dead volumes. In this way, sedimentation of solids may be reduced. The first base may comprise protrusions, for example corrugations, arranged to increase turbulence of flowing water. In this way, resuspension of deposited solids may be increased, thereby reducing sedimentation of the solids. In one example, the first base is a planar base. In use, the storm water flows from the first inlet to the first outlet via the first chamber, across or over the first base.

The second base may be arranged similarly to the first base. In use, the sewage water flows from the second inlet to the second outlet via the second chamber, across or over the second base.

The first wall is arranged between the first access port and the first base. In other words, the first wall extends between the first access port and the first base. The first wall may comprise a planar portion. In this way, manufacturing and/or installation may be facilitated and/or costs reduced. The first wall may comprise a non-planar portion. The first wall may comprise a curved portion, for example a cylindrical portion. In this way, strength such as to internal and/or external loading may be increased. The first wall may comprise a concave portion and/or a convex portion. In one example, the first wall comprises a cylindrical wall. In one example, the first wall is a cylindrical wall. The first base and the first wall define a first volume to receive the storm water.

The second wall may be arranged similarly to the first wall. The second base and the second wall define a second volume to receive the sewage water.

The first normal to the first base extends through the first base and the second base. It should be understood that the first normal extends through a first region defined by a first perimeter of the first base, such as a boundary, a border, a circumference or an outer circumference of the first base. The first perimeter may be defined by the intersection of the first base and the first wall, for example. It should be understood that the second normal extends through a second region defined by a second perimeter of the second base, such as a boundary, a border, a circumference or an outer circumference of the second base. The second perimeter may be defined by the intersection of the second base and the second wall, for example.

The first normal is a first line or a first vector arranged orthogonally (i.e. perpendicularly) to the first base and extending therethrough. For example, if the first base comprises a planar portion and the first normal extends through this planar portion, the first normal is perpendicular to this planar portion. For example, if the first base comprises a non-planar portion such as a hemispherical portion and the first normal extends through this non-planar portion, the first normal extends radially through this hemispherical portion. The first normal to the first base may extend centrally or substantially centrally through the first base, such as through a central portion of the first base. Conversely, the first normal to the first base may extend through a non-central portion of first base. It should be understood that the first normal to the first base may not be normal to the second base. For example, if the first base and the second base comprise non-parallel planar portions and the first normal extends through the planar portion of the first base, the first normal may thus be non-perpendicular to the second base. For example, if the first base and the second base comprise non-planar portions such as hemispherical portions and the first normal extends radially through the hemispherical portion of the first base, the first normal may thus extend non-radially through the second base.

In one example, the first base and the second base are at least partially superposed. In one example, the first base and the second base are superposed. In one example, a projection of the first base is at least partly within a projection of the second base, or vice versa. In one example, a projection of the first base is at wholly within a projection of the second base, or vice versa. In one example, a projection of the first base is different from a projection of the second base. In this way, the manhole excludes arrangements in which the first base and the second base are adjacent.

In one example, the first base and the second base are arranged in different planes. That is, the first base and second base may not be coplanar. In one example, the first base and the second base are arranged in a same plane. That is, the first base and second base may be coplanar.

In one example, the first chamber comprises a first weir or interceptor, arranged to intercept, for example, floating matter thereby preventing the floating matter from exiting the first outlet.

In one example, the second chamber comprises a second weir or interceptor, arranged to intercept, for example, floating matter thereby preventing the floating matter from exiting the second outlet.

In one example, the manhole is arranged to isolate the first chamber from the second chamber, such that the storm water is isolated from the sewage water in normal use. For example, at least one of the first wall, the first base, the second wall or the second base may be arranged to isolate the first chamber from the second chamber, such that the storm water is isolated from the sewage water in normal use. That is, within the manhole, the sewage water may be isolated from the storm water. As with conventional separate sewer manholes, it should be understood that in use, the first chamber may be in gas communication with the second chamber via the first access port and/or the second access port. As with conventional separate sewer manholes, it should be understood that in normal use, the storm water in the first chamber may be isolated from the sewage water in the second chamber. However, as with conventional separate sewer manholes, it should be understood that in exceptional use, such as during heavy rain, flooding and/or blockage, the first chamber may be in liquid communication with the second chamber via the first access port and/or the second access port. That is, as with conventional separate sewer manholes, blockage of the second outlet, for example, may result in overflow of sewage water from the second chamber via the second access port and into the first chamber via the first access port. Overflow of storm water may considered similarly.

In one example, a second normal to the second base extends through the second base and the first base. The second normal is a second line or a second vector arranged orthogonally to the second base and extending therethrough. The first normal and the second normal may be mutually inclined. Conversely, the first normal and the second normal may be mutually parallel. The first normal and the second normal may intersect. Conversely, the first normal and the second normal may not intersect. The first normal and the second normal may be colinear.

In one example, the first chamber and the second chamber are superposed. For example, the first chamber may be arranged partly or wholly above the second chamber, in use. Conversely, for example, the second chamber may be arranged partly or wholly above the first chamber, in use. In this way, a footprint of the manhole may be reduced, thereby facilitating installation since excavation for the manhole may be reduced. In this way, a loading of the ground may be improved and/or a strength of the manhole increased.

In one example, the first chamber and the second chamber are arranged substantially coaxially or coaxially. For example, the first chamber and the second chamber may be superposed coaxially. In this way, a manufacturing may be facilitated and/or a strength of the manhole may be increased.

In one example, the second chamber is arranged at least partly within the first chamber. It should be understood that the first chamber and the second chamber are separate chambers. That is, for example, the second wall may protrude through the first base and/or the first wall, while the first chamber and the second chamber are maintained as separate chambers.

In one example, the second chamber extends at least partly through the first chamber. For example, the first chamber may be toroidal and the second chamber may be cylindrical, extending at least partly through a passageway defined by the toroidal first chamber. In this way, for example, the first access port and the second access port may be coplanar while the first base and the second base may be arranged in different planes.

In one example, the first inlet and the second inlet are aligned about the first normal. For example, the first inlet and the second inlet may be at least partly or wholly superposed. In this way, a first inlet pipe coupled to the first inlet and a second inlet pipe coupled to the second inlet may be at least partly or wholly superposed, in use. In this way, structural integrity of a sewer network may be improved, as described below.

In one example, the first outlet and the second outlet are aligned about the first normal. For example, the first outlet and the second outlet may be at least partly or wholly superposed. In this way, a first outlet pipe coupled to the first outlet and a second outlet pipe coupled to the second outlet may be at least partly or wholly superposed, in use. In this way, structural integrity of a sewer network may be improved, as described below.

In one example, the first inlet is opposed to the first outlet. For example, the first inlet and the first outlet may be diametrically opposed. In this way, flow of the storm water via the first chamber may be improved.

In one example, the second inlet is opposed to the second outlet. For example, the second inlet and the second inlet may be diametrically opposed. In this way, flow of the sewage water via the second chamber may be improved.

In one example, the first access port and the second access port are substantially coplanar. In one example, the first access port and the second access port are arranged in different planes.

In one example, the second access port is accessed via the first chamber. For example, the second access port may be arranged in the first base. In this way, a footprint of the manhole may be reduced.

In one example, the first wall comprises a cylindrical wall. For example, the first chamber may be cylindrical. In this way, resistance to internal and/or external loading may be increased. In this way, material usage may be reduced.

In one example, the second wall comprises a cylindrical wall. For example, the second chamber may be cylindrical. In this way, resistance to internal and/or external loading may be increased. In this way, material usage may be reduced.

In one example, the first chamber and the second chamber are arranged concentrically. For example, the first chamber and the second chamber may be cylindrical and coaxial.

In one example, at least one of the first inlet and the first outlet is arranged through the first wall. In one example, the first inlet and the first outlet are arranged through the first wall. In one example, at least one of the first inlet and the first outlet is arranged through the first wall proximal the first base. In one example, the first inlet and the first outlet are arranged through the first wall proximal the base.

In one example, at least one of the second inlet and the second outlet is arranged through the second wall. In one example, the second inlet and the second outlet are arranged through the second wall. In one example, at least one of the second inlet and the second outlet is arranged through the second wall proximal the second base. In one example, the second inlet and the second outlet are arranged through the second wall proximal the base.

In one example, at least one of the first inlet and the first outlet is arranged through the first base. In one example, the first inlet and the first outlet are arranged through the first base.

In one example, at least one of the second inlet and the second outlet is arranged through the second base. In one example, the second inlet and the second outlet are arranged through the second base.

In one example, the manhole comprises a material selected from a metal material, a polymeric material, a ceramic material and a composite material. The metal material may comprise iron or an alloy thereof, such as steel or ductile iron. The polymeric material may comprise a thermoplastic polymer, such as polyvinyl chloride (PVC) or high-density polyethylene (HDPE). PVC is suitable from cost and hydraulic operation aspects and has a long useful life of about 100 years. The ceramic material may comprise clay. The composite material may include concrete, such as reinforced concrete, or glass reinforced plastic (GRP). Pipes may comprise similar materials.

In one example, the manhole comprises a sensor arranged to determine, for example sense, detect, determine, measure and/or monitor, a water level. For example, the manhole may comprise a first sensor arranged to measure a level of the storm water in the first chamber. For example, the manhole may comprise a second sensor arranged to measure a level of the sewage water in the second chamber. In this way, the level of the storm water in the first chamber and/or the level of the sewage water in the second chamber may be sensed.

In one example, the manhole comprises a transmitter arranged to transmit a signal, for example an overflow signal, a warning signal or an alarm signal, according to the sensed water level. In this way, the sensed water level may be received remotely and appropriate action may be taken, for example inspection and/or maintenance.

In one example, the manhole comprises a vent, for example, a passageway or a conduit arranged between the first chamber or the second chamber and the surface of the ground.

In one example, the first chamber comprises a plurality of first inlets and/or first outlets.

In one example, the second chamber comprises a plurality of second inlets and/or second outlets.

In one example, the first chamber comprises a first cover, arrangeable to close the first access port. In one example, the second chamber comprises a second cover, arrangeable to close the second access port.

The second aspect provides a sewer network for storm water and for sewage water, the network comprising a first manhole according to the first aspect, a second manhole according to the first aspect, and a first pipe and a second pipe extending therebetween;

wherein the first pipe is coupled to the first outlet of the first manhole and to the first inlet of the second manhole; and wherein the second pipe is coupled to the second outlet of the first manhole and to the second inlet of the second manhole;

wherein the first pipe and the second pipe are superposed for at least a part of their respective lengths.

In this way, installation of the sewer network is facilitated since a single excavation or trench is required, compared with two such excavations required for conventional separate sewer networks.

In this way, since the first pipe and the second pipe are superposed for at least a part of their respective lengths, deflection of the first pipe and/or the second pipe may be reduced. In this way, settling and/or subsidence of the ground may be reduced.

The third aspect provides a method of installing a sewer network according to the second aspect, the method comprising:

providing an excavation arranged to receive the first manhole, the second manhole and the first pipe and the second pipe extending therebetween;

arranging the first manhole, the second manhole and the first pipe and the second pipe extending therebetween in the excavation;

coupling the first pipe to the first outlet of the first manhole and to the first inlet of the second manhole;

coupling the second pipe to the second outlet of the first manhole and to the second inlet of the second manhole;

wherein the first pipe and the second pipe are superposed for at least the part of their respective lengths; and backfilling the excavation.

In one example, the method comprises providing a part of a roadway over the backfilled excavation.

In one example, providing the excavation comprises removing a part of an existing roadway. In this way, the sewer network may be installed in existing roadways, for example to supplement or replace existing conventional sewer networks.

In one example, the first chamber of the first manhole is toroidal and the second chamber of the first manhole is cylindrical, extending at least partly through a passageway defined by the toroidal first chamber, wherein the second chamber of the first manhole is an existing second chamber in the excavation and wherein arranging the first manhole in the excavation comprises arranging the first chamber of the first manhole around the existing second chamber. In one example, the first chamber of the second manhole is toroidal and the second chamber of the second manhole is cylindrical, extending at least partly through a passageway defined by the toroidal first chamber, wherein the second chamber of the second manhole is an existing second chamber in the excavation and wherein arranging the second manhole in the excavation comprises arranging the first chamber of the second manhole around the existing second chamber. In one example, the second chamber of the first manhole is an existing second chamber in the excavation and the second chamber of the second manhole is an existing second chamber in the excavation. In other words, the sewer network may be used to improve existing combined sewer networks by adding the external chamber (i.e. the first chamber for example a storm chamber) to the existing manholes used in the existing combined networks, and installing pipes for storm water above the combined pipe which will use only for the sewage flow. This method is promising to solve the combined sewer system in the narrow streets prevalent in UK and EU cities.

BRIEF DESCRIPTION OF THE FIGURES

For a better understanding of the invention, and to show how exemplary embodiments of the same may be brought into effect, reference will be made, by way of example only, to the accompanying diagrammatic figures, in which.

DETAILED DESCRIPTION OF VARIOUS EMBODIMENTS

Figure 1A:
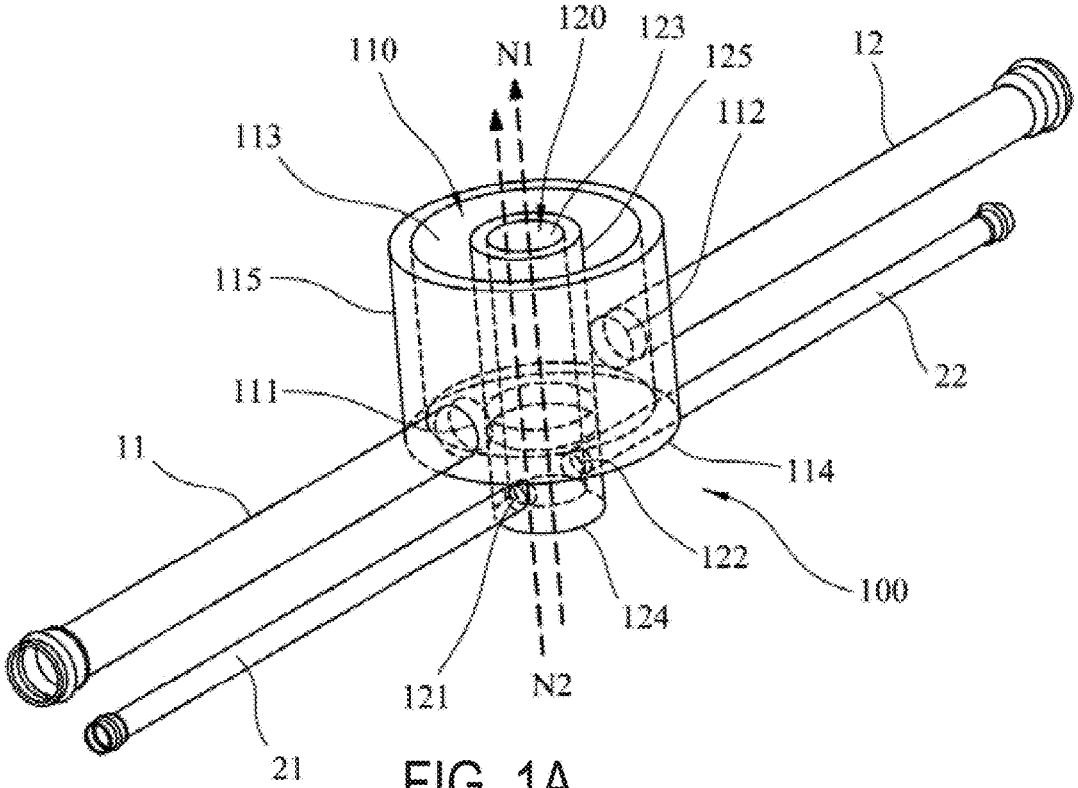
FIG. 1A schematically depicts an orthographic projection of a manhole according to an exemplary embodiment of the invention.
Figure 1B:
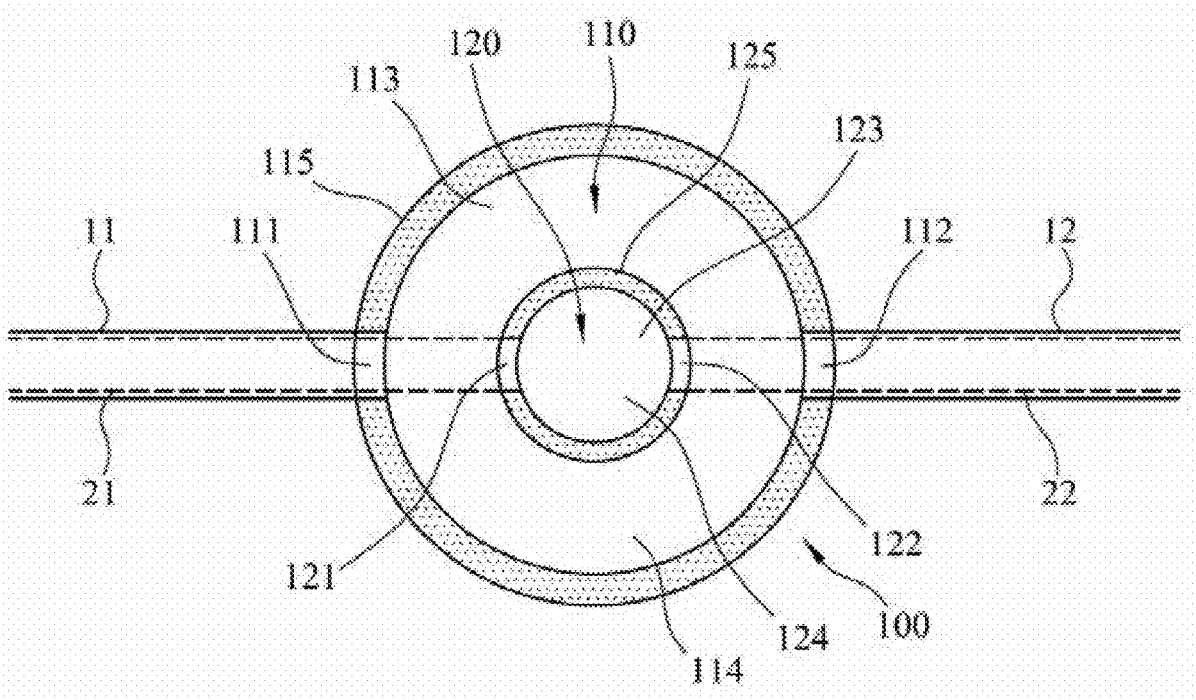
FIG. 1B schematically depicts a plan view of the manhole of FIG. 1A.
Figure 1C:
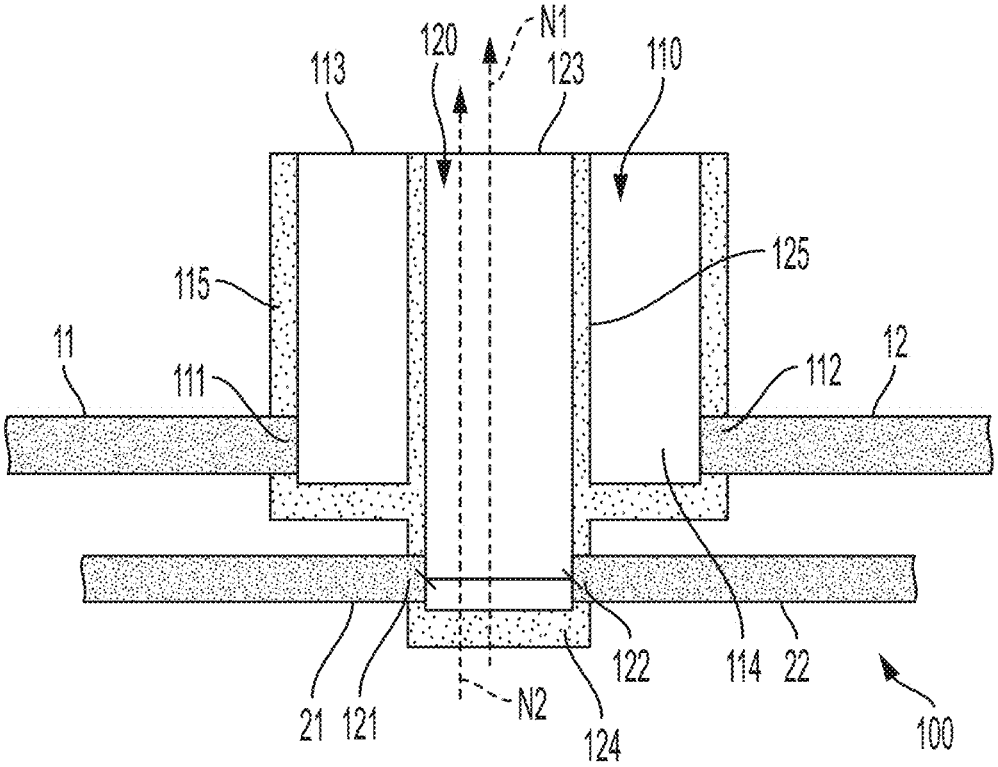
FIG. 1C schematically depicts a longitudinal cross section of the manhole of FIG. 1A.

FIG. 1A schematically depicts an orthographic projection of a manhole 100 according to an exemplary embodiment of the invention. FIG. 1B schematically depicts a plan view of the manhole 100. FIG. 1C schematically depicts a longitudinal cross section of the manhole 100. The manhole 100 is for subterranean installation.

The manhole 100 comprises a first chamber 110 arranged to receive storm water and a second chamber 120 arranged to receive sewage water. The first chamber 110 comprises a first inlet 111 and a first outlet 112. The second chamber 120 comprises a second inlet 121 and a second outlet 122. The first chamber 110 comprises a first access port 113 opposed to a first base 114 and a first wall 115 arranged therebetween. The second chamber 120 comprises a second access port 123 opposed to a second base 124 and a second wall 125 arranged therebetween. A first normal N1 to the first base 114 extends through the first base 114 and the second base 124.

The second chamber 120 is cylindrical, having a length of 2.69 m, an outer diameter of 1.00 m and a wall thickness of 0.10 m. The second base 124 is flat, having a thickness of 0.15 m, and the second access port 123 is provided by an open end of the second chamber 120. The first chamber 110 is toroidal, having a length of 2.00 m, an outer diameter of 2.50 m, an inner diameter of 1.00 m and a wall thickness of 0.15 m. The first base 114 is flat, having a thickness of 0.15 m, and the first access port 113 is provided by an open end of the first chamber 110. The open ends of the first chamber 110 and the second chamber 120 (i.e. the first access port 113 and the second access port 123) are coplanar. The first chamber 110 surrounds the second chamber 120 coaxially. The second wall 125 of the second chamber 120 separates the second chamber 120 from the first chamber 110. The manhole 100 is formed from concrete, or/and GRP or/and HDPE or/and PVC or/and any other material can use in constructing manholes. As would be understood by the person skilled in the art, dimensions of the manhole 100 may be changed, for example according to the material, design circumstances of each case in the field, and/or depth of a sewer network.

A second normal N2 to the second base 124 extends through the second base 124 and the first base 114. The first chamber 110 and the second chamber 120 are superposed. The first chamber 110 and the second chamber 120 are arranged coaxially. The second chamber 120 is arranged at least partly within the first chamber 110. The second chamber 120 extends at least partly through the first chamber 110. The first inlet 111 and the second inlet 121 are aligned about the first normal N1. The first outlet 112 and the second outlet 122 are aligned about the first normal N2. The first inlet 111 is opposed to the first outlet 112. The first wall 115 comprises a cylindrical wall. The second wall 125 comprises a cylindrical wall. The first chamber 110 and the second chamber 120 are arranged concentrically. The first inlet 111 and the first outlet 112 are arranged through the first wall 115. The second inlet 121 and the second outlet 122 are arranged through the second wall 125.

Also shown are a first inlet pipe 11 coupled to the first inlet 111 and a first outlet pipe 12 coupled to the first outlet 112. Also shown are a second inlet pipe 21 coupled to the second inlet 121 and a second outlet pipe 22 coupled to the second outlet 122. The first inlet pipe 11 and the second inlet pipe 21 are superposed for their respective lengths, the first inlet pipe 11 being arranged above the second inlet pipe 21. The first outlet pipe 12 and the second outlet pipe 22 are superposed for their respective lengths, the first outlet pipe 12 being arranged above the second outlet pipe 22.

Figure 2:
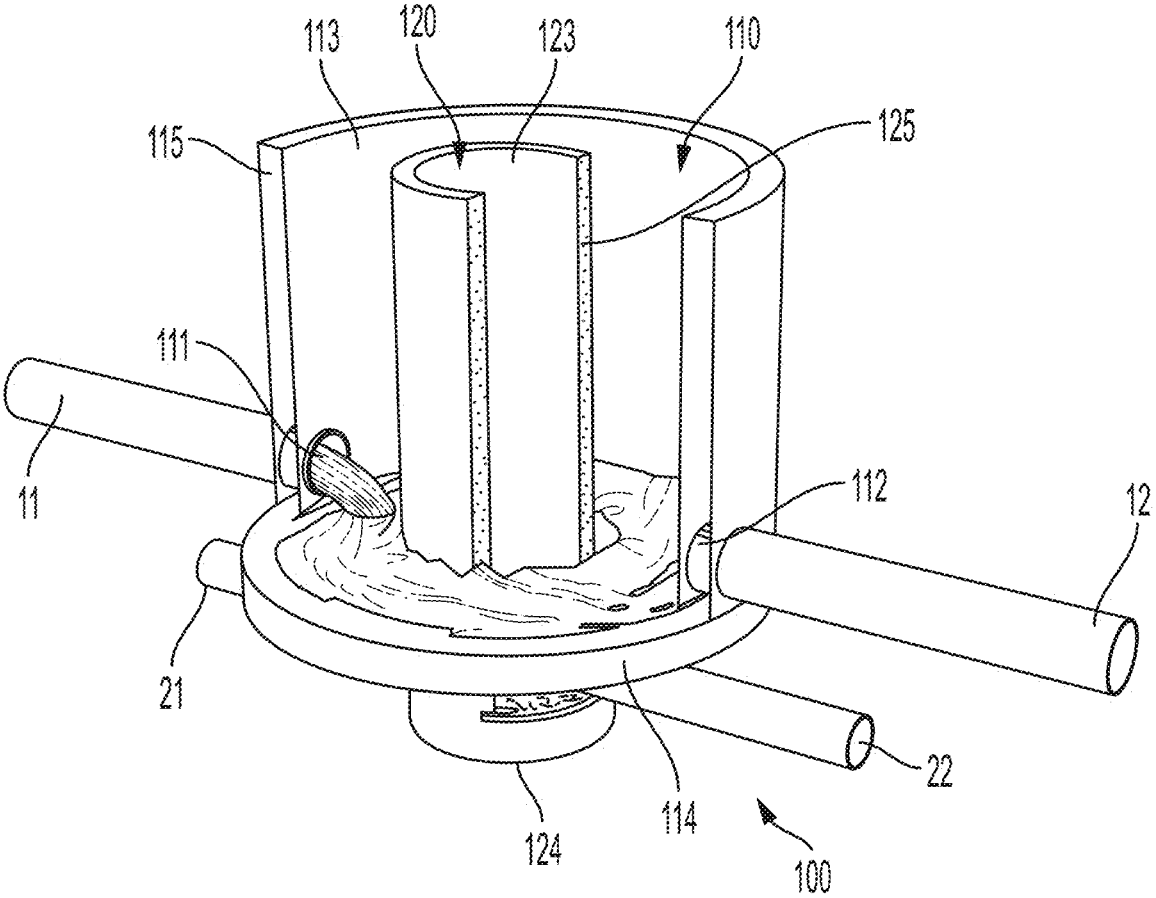
FIG. 2 schematically depicts a cutaway orthographic projection of the manhole of FIG. 1A, in use.

FIG. 2 schematically depicts a cutaway orthographic projection of the manhole of FIG. 1, in use.

In use, the storm water flows from the first inlet 111 to the first outlet 112 via the first chamber 110, across or over the first base 114. In use, the sewage water flows from the second inlet 121 to the second outlet 122 via the second chamber 120, across or over the second base 124.

Figure 3:
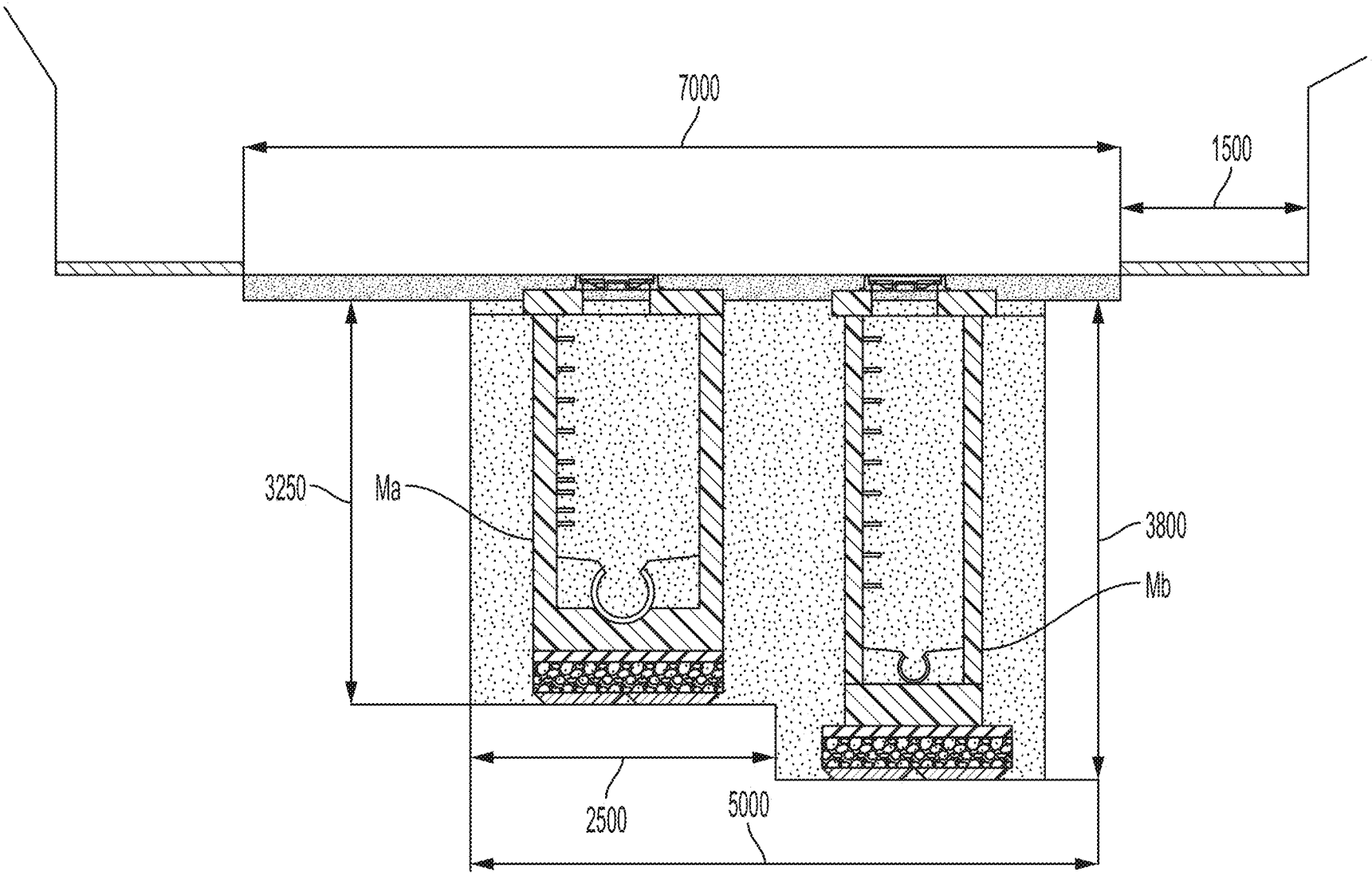
FIG. 3 schematically depicts a cross sectional view of conventional manholes, in use.

FIG. 3 schematically depicts a cross sectional view of conventional manholes, in use. Particularly, FIG. 3 shows two conventional manholes Ma and Mb spaced apart laterally under a street, according to a conventional arrangement. The manholes Ma and Mb are for storm water and for sewage water, respectively. In this cross section, the manholes Ma and Mb require for installation an excavation having a cross sectional area of about 17.5 $m^2$, for open-cut installation without use of side supports, for a given depth.

Figure 4:
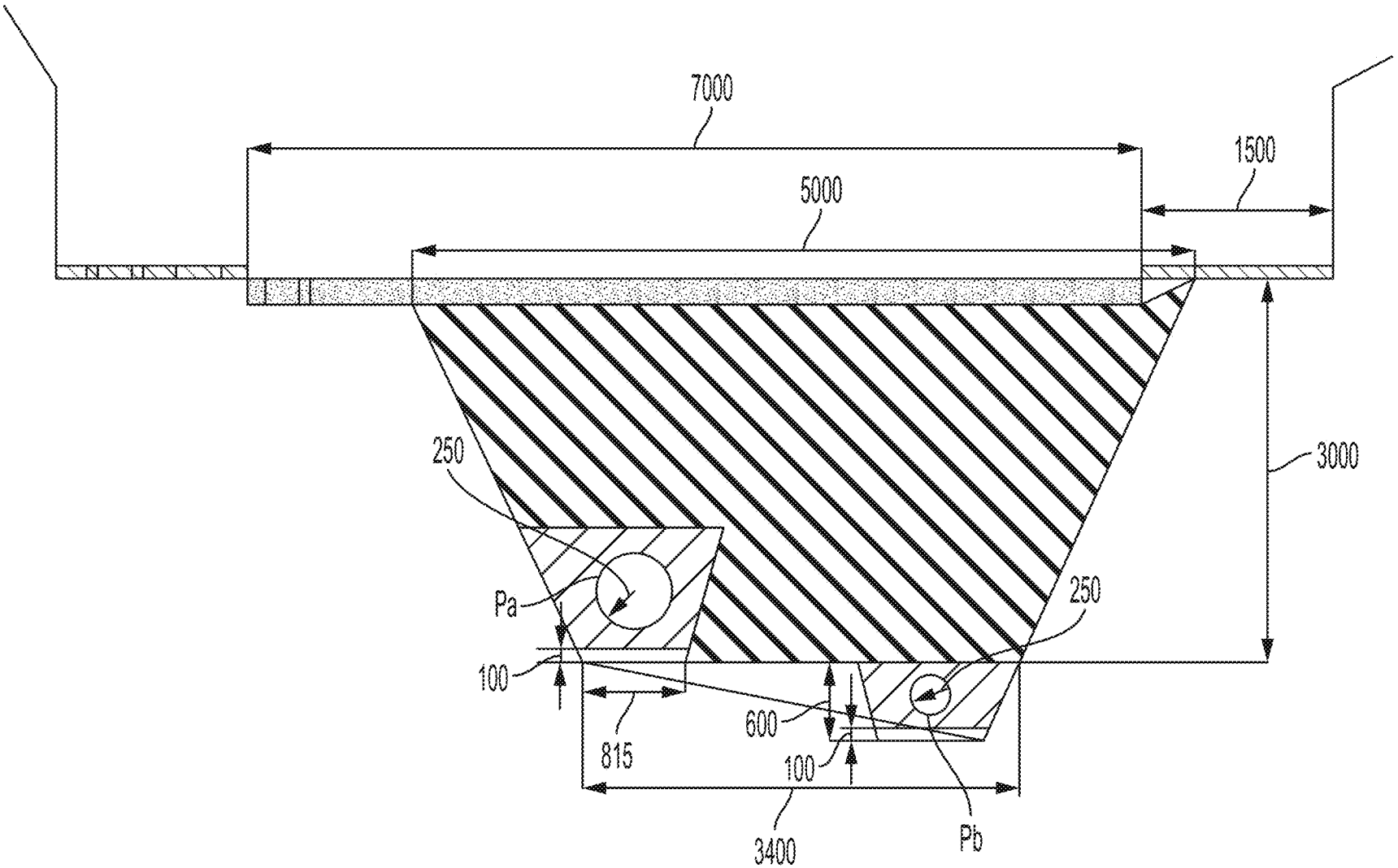
FIG. 4 schematically depicts a cross sectional view of a conventional arrangement of pipes, in use.

FIG. 4 schematically depicts a cross sectional view of a conventional arrangement of pipes, in use. Particularly, FIG. 4 shows two pipes Pa and Pb spaced apart laterally under a street, according to a conventional arrangement. The pipes Pa and Pb are for storm water and for sewage water, respectively. In this cross section, the pipes Pa and Pb require for installation an excavation or trench having a cross sectional area of about 12 $m^2$, for open-cut installation without use of side supports, fora given depth.

Figure 5:
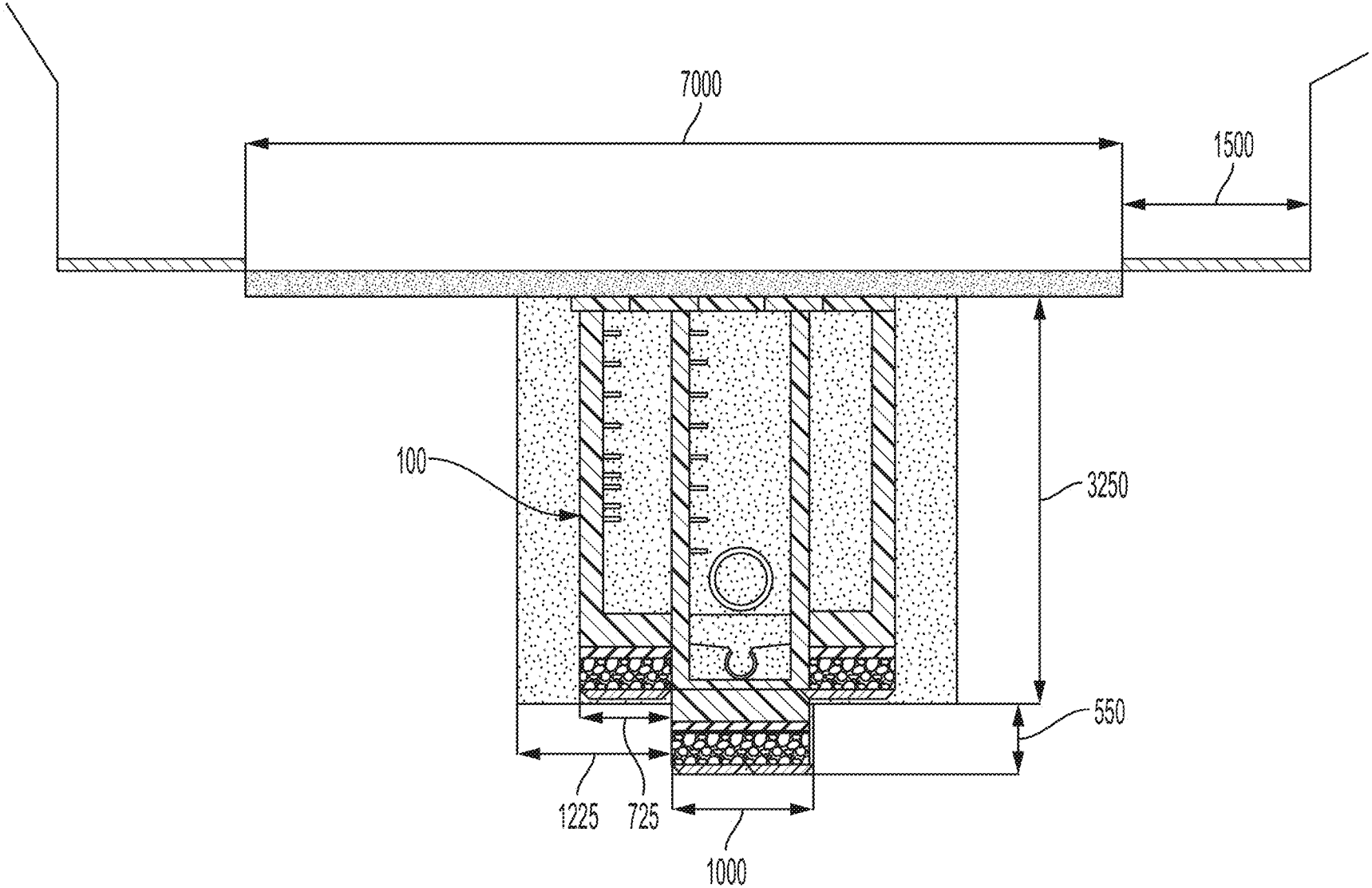
FIG. 5 schematically depicts a cross sectional view of the manhole of FIG. 1A, in use.

FIG. 5 schematically depicts a cross sectional view of the manhole 100 of FIG. 1, in use. Particularly, FIG. 5 shows the manhole 100 under a street. In this cross section, the manhole 100 requires for installation an excavation having a cross sectional area of about 12 $m^2$, for open-cut installation without use of side supports, for a given depth.

Figure 6:
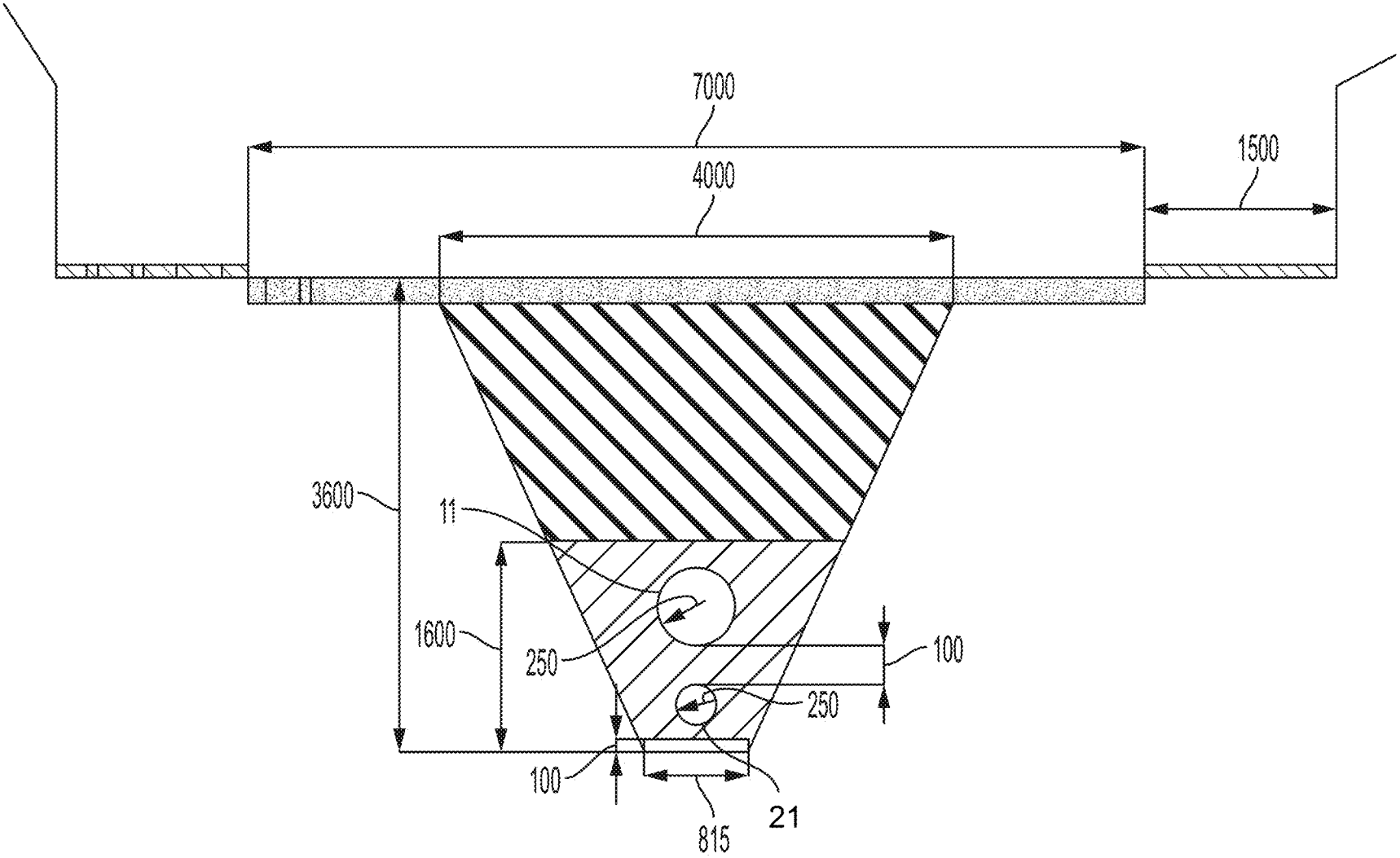
FIG. 6 schematically depicts a cross sectional view of an arrangement of pipes for use with the manhole of FIG. 1A, in use.

FIG. 6 schematically depicts a cross sectional view of an arrangement of pipes for use with the manhole of FIG. 1, in use. Particularly, FIG. 6 shows the superposed first inlet pipe 11 and the second inlet pipe 21 spaced apart vertically under a street, according to an exemplary embodiment of the invention. The first inlet pipe 11 and the second inlet pipe 21 are for storm water and for sewage water, respectively. In this cross section, the first inlet pipe 11 and the second inlet pipe 21 require for installation an excavation or trench having a cross sectional area of about 8 $m^2$, for open-cut installation without use of side supports, for a given depth.

In this way, installation of the manhole 100 requires less excavation compared with installation of the conventional manholes Ma and Mb. In this way, installation of the superposed first inlet pipe 11 and the second inlet pipe 21 requires less excavation compared with installation of the laterally spaced apart conventional pipes Pa and Pb. In this way, cost and/or construction time may be decreased. In this way, the manhole 100 and the superposed first inlet pipe 11 and the second inlet pipe 21 occupy a smaller footprint in and/or under the street, providing more space for other infrastructure services in and/or under the street.

Analysis of Soil-Manhole Interactions

Finite element analysis (FEA) allows modelling of soil S and a prototype of manhole arrangements mathematically and test them over a variety of load conditions or boundary conditions, and to test the shape of the manhole 100 over a variety of load conditions or boundary conditions.

Figure 7A:
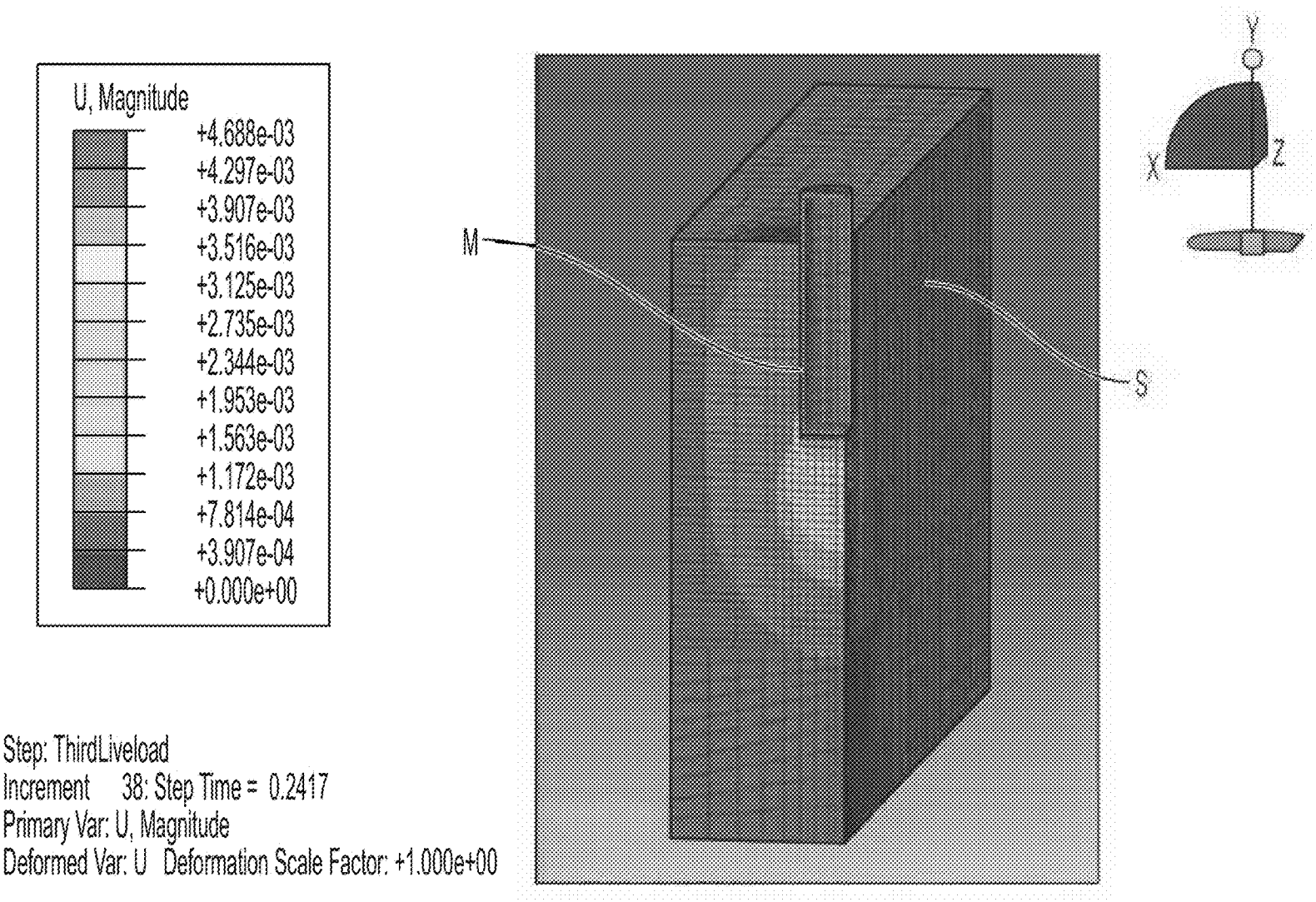
FIGS. 7A and 7B schematically depict transverse and longitudinal cross sections, respectively, of finite element analysis of a conventional manhole, in use.
Figure 7B:
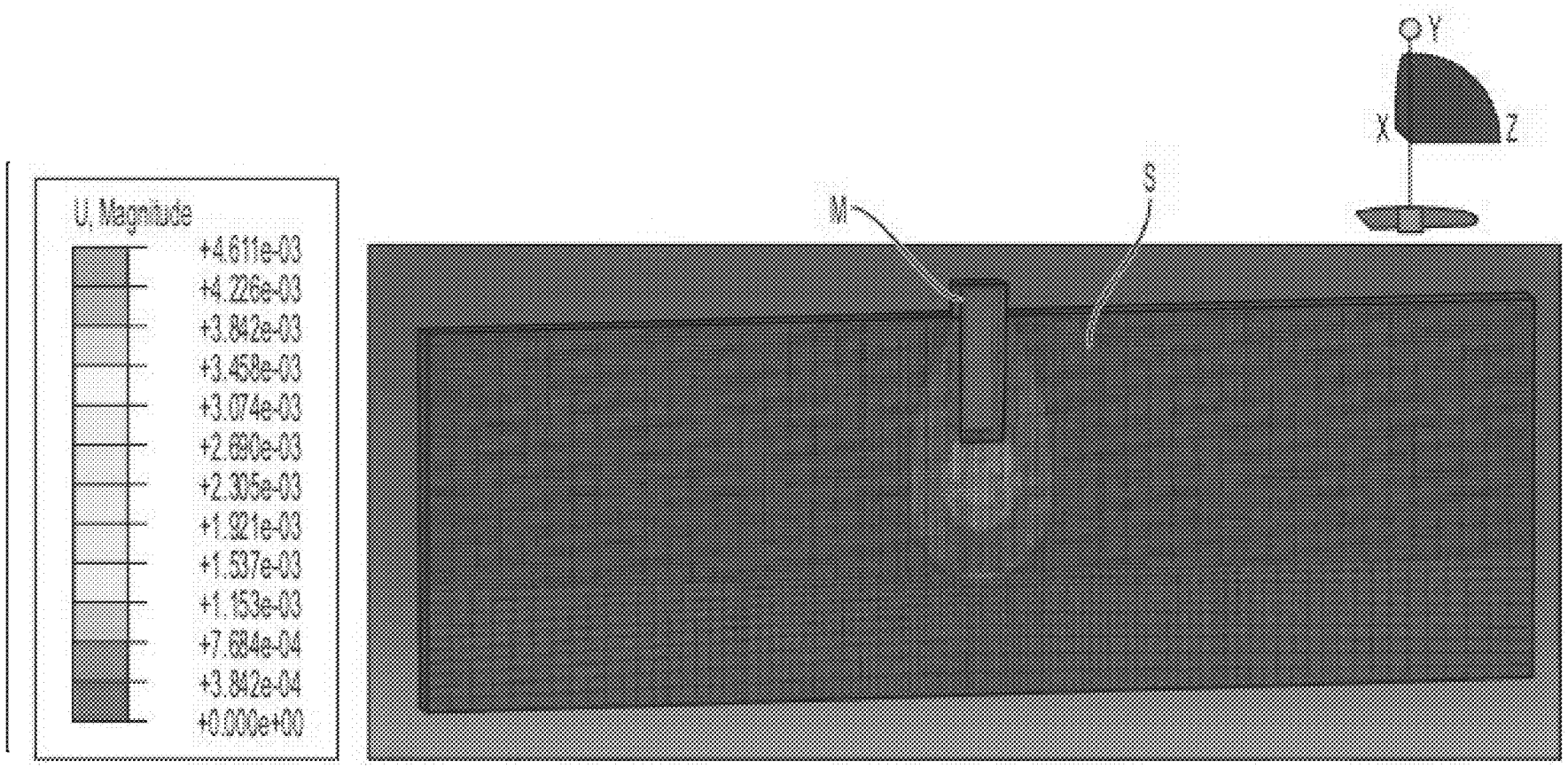

FIGS. 7A and 7B schematically depict transverse and longitudinal cross sections, respectively, of FEA of a conventional manhole M, in use. Particularly, FIGS. 7A and 7B show FEA, performed using ABAQUS (®) FEA software (available from Dassault Systèmes Simulia Corp, R.I., USA), of soil S surrounding the conventional manhole M, according to a 3 dimensional (3D) model. As an example, displacement or settlement of the soil S and hence of the manhole M is due to a weight of the manhole M and an applied load of 20 kN, to simulate usage, displacement of the soil S of approximately 4.5 mm is observed. Different loadings, such as 10 kN, 15, kN and 20 kN were applied, to simulate different usage. At higher loadings, displacement of the conventional manhole M exceeded limits of the FEA.

Figure 8A:
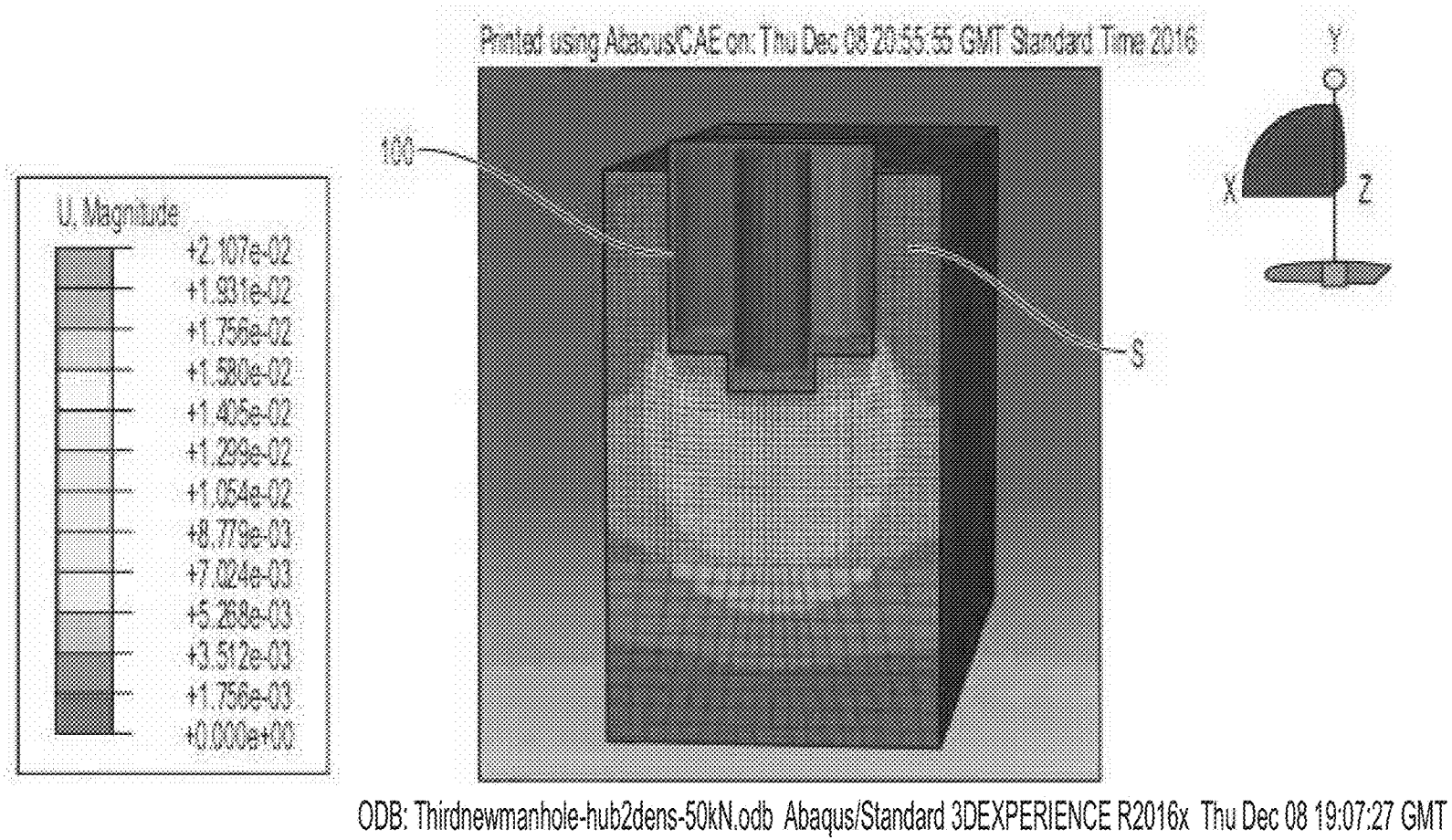
FIGS. 8A and 8B schematically depict transverse and longitudinal cross sections, respectively, of finite element analysis of the manhole of FIG. 1A, in use.
Figure 8B:
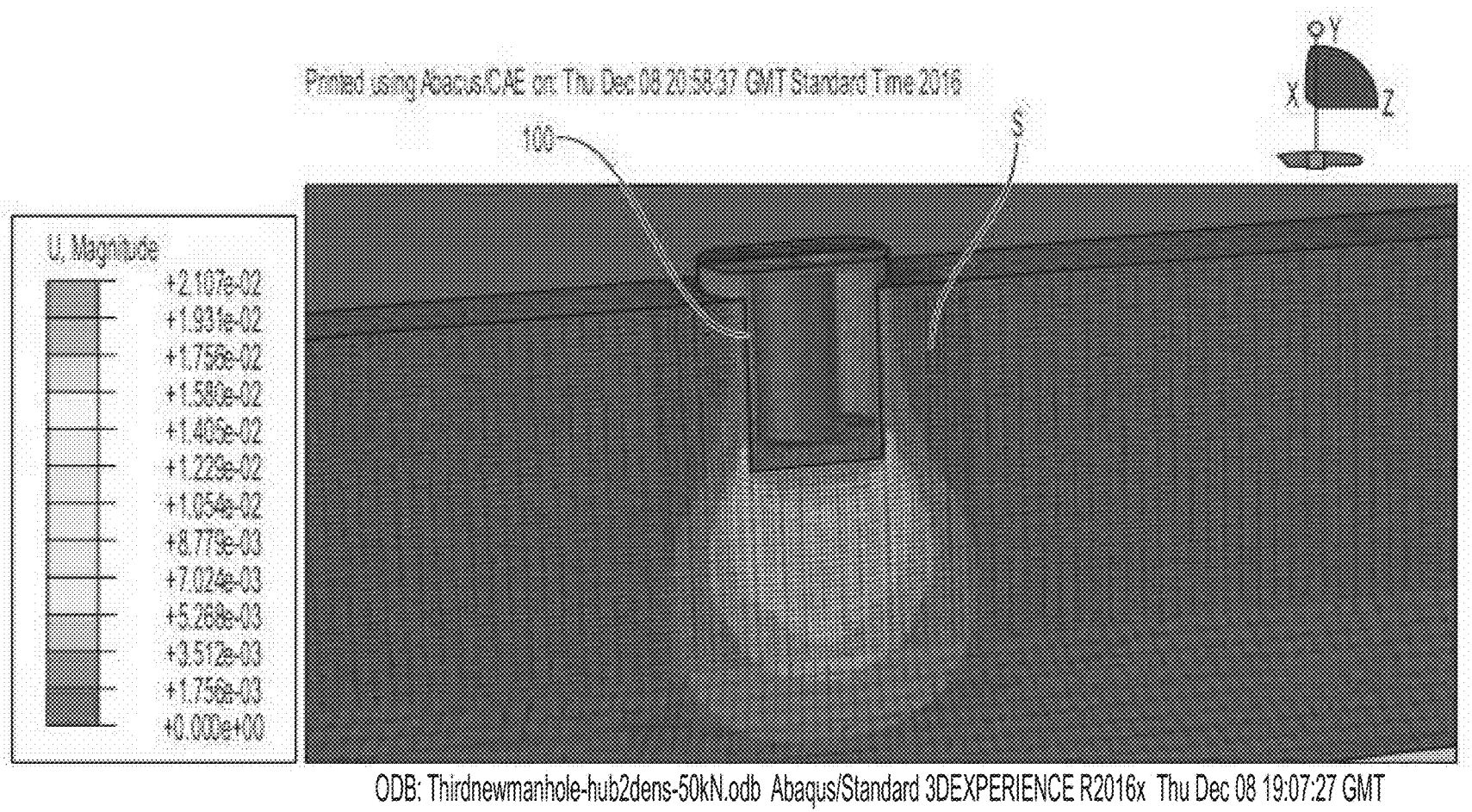

FIGS. 8A and 8B schematically depict transverse and longitudinal cross sections, respectively, of finite element analysis of the manhole 100, in use Particularly, FIGS. 8A and 8B show FEA, performed using ABAQUS, of soil S surrounding the manhole 100, according to a 3 dimensional (3D) model. As an example, displacement or settlement of the soil S and hence of the manhole 100 is due to a weight of the manhole 100 and an applied load of 50 kN, to simulate usage, displacement of the soil S of approximately 2.1 cm is observed. Different loadings, such as 10 kN, 15, kN, 20 kN and 50 kN were applied, to simulate different usage.

In this way, displacement or settlement of the soil S and hence of the manhole 100 is approximately half of that determined for the conventional manhole M, fora given load.

Figure 9:
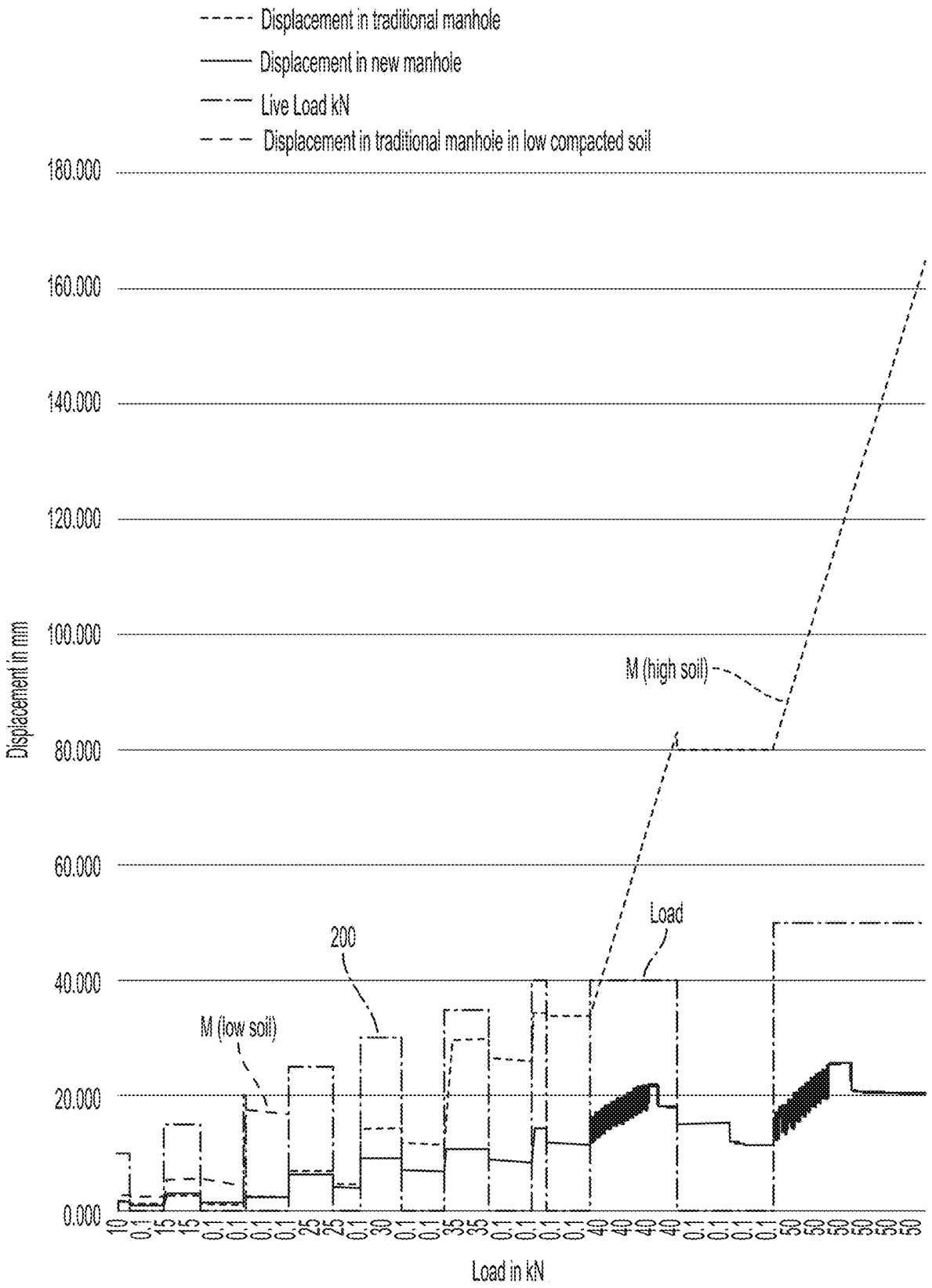
FIG. 9 schematically depicts graphs of displacement of a conventional manhole and of a manhole according to an exemplary embodiment of the invention, in use.

FIG. 9 schematically depicts graphs of displacement of a conventional manhole M and of a manhole 200 according to an exemplary embodiment of the invention, in use. Particularly, the data shown in the graphs was obtained for a scale model of the conventional manhole M and the manhole 200, which is a scale model of the manhole 100. The conventional manhole M was fabricated from a steel tube having an endplate, of length 0.30 m and of external diameter 0.10 m. The manhole 200 was fabricated from two steel tubes having end plates, providing a first chamber 210 and a second chamber 220 respectively, according to the design of the manhole 100. The first chamber 210 was of length 0.25 m and of external diameter 0.25 m. The second chamber 220 was of length 0.30 m and of external diameter 0.10 m.

Normal live load on a manhole from traffic is about 16 tons (160 kN). When scaling this load to the surface area of the manhole 200, it will be 14 kN.

The resistance of the manhole 200 to live loads has shown superiority of this shape with regards to loading from the traditional design of the conventional manhole M. Results showed that under 50KN which is 3.5 times of the normal load, the manhole 200 can still resist the load and remain stable.

The conventional manhole M has a higher displacement than the manhole 200 in low compacted soil by less than 2 times. The conventional manhole M sank under a 20 kN load.

When the soil has a high compacted value, the conventional manhole M has a similar displacement compared with the manhole 100 in low compacted soil at load 35 kN which is about 2 times higher normal load value. However, the conventional manhole M sank under 35 kN load while manhole 200 remains stable even under a 50 kN load.

The manhole 200 has a higher capacity to carry live loads compared with the conventional manhole M. This improvement can mitigate collapse risk that many sewer networks have and make the sewer system more stable against a shock live load in addition of other advantages such as decrease the initial construction cost of sewer system and environment protection by separate storm water flow from sewage water flow.

Figure 10A:
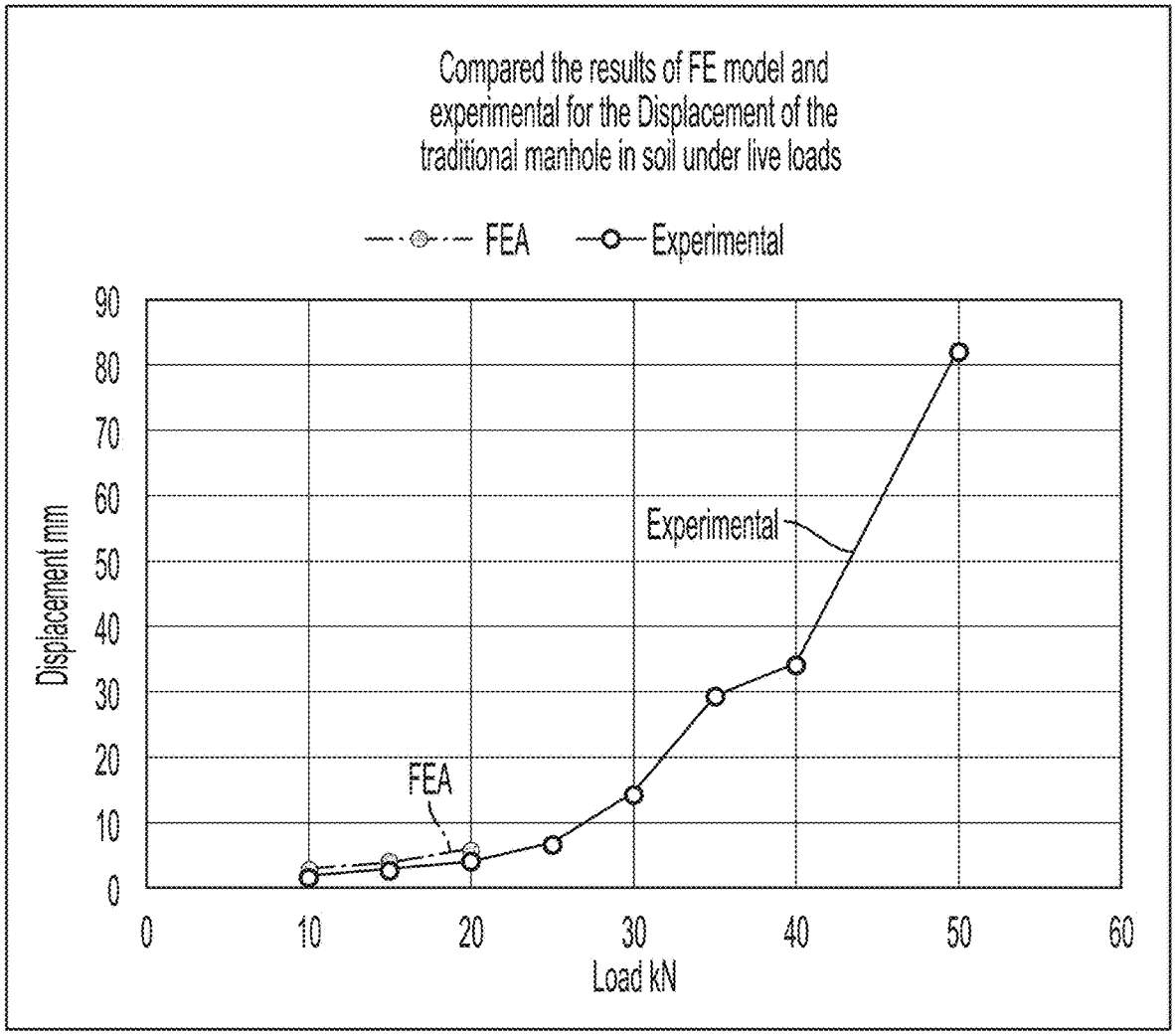
FIG. 10A schematically depicts graphs of displacement of the conventional manhole of FIGS. 7A and 7B, compared with displacement of the conventional manhole of FIG. 9, in use.

FIG. 10A schematically depicts graphs of displacement of the conventional manhole M of FIGS. 7A and 7B, compared with displacement of the conventional manhole M of FIG. 9, in use. That is, the results of the FEA and the experimental analysis are compared, with good correlation.

Figure 10B:
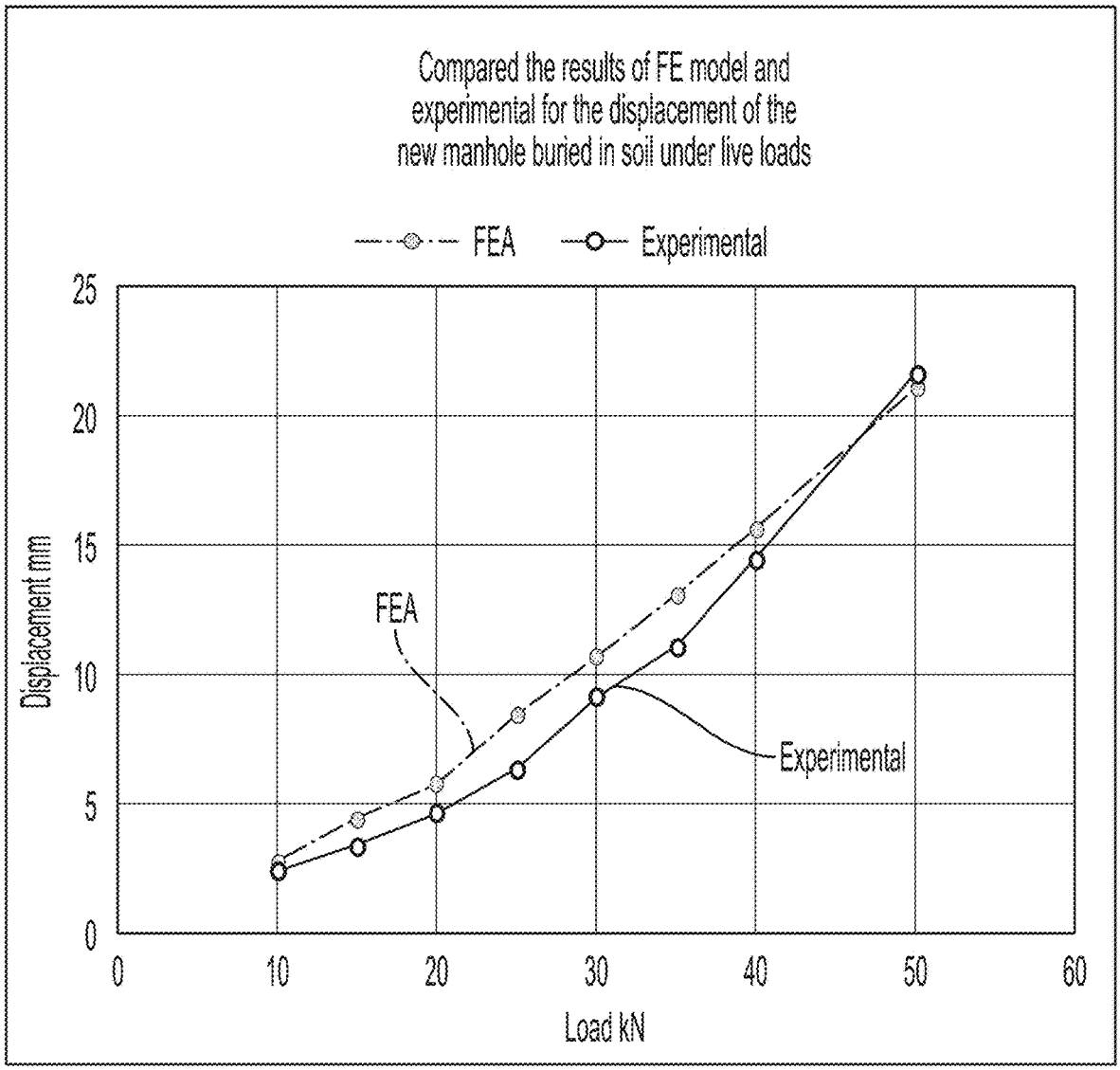
FIG. 10B schematically depicts graphs of displacement of the manhole of FIGS. 8A and 8B, compared with displacement of the manhole of FIG. 9, in use.

FIG. 10B schematically depicts graphs of displacement of the manhole 100 of FIGS. 8A and 8B, compared with displacement of the manhole 100 of FIG. 9, in use. That is, the results of the FEA and the experimental analysis are compared, with good correlation.

Analysis of Soil-Pipe Interactions

Soil is a texture (i.e. a material) in which sewer system appurtenances such as manholes, pump stations and pipelines, are embedded. The ability to simulate the interactive behaviour of the materials in these objects with soil is considered one of the more complicated challenges due to the complex media of soil. This can include different types of solid matter peppered with voids which can be filled by air or water or other liquids, creating a variety of soil stiffness, subject to a variety of loading and unloading conditions. Sewer system structure performance is a function of both soil type (soil shear strength properties) and pipe stiffness. Mathematical analyses use soil property criteria, in parallel with pipe material properties, to model the soil and pipe structure properties mathematically. FEA is a tool suitable for testing pipes in soils over a variety of load conditions and boundary conditions as well as the system in its entirety.

Figure 11A:
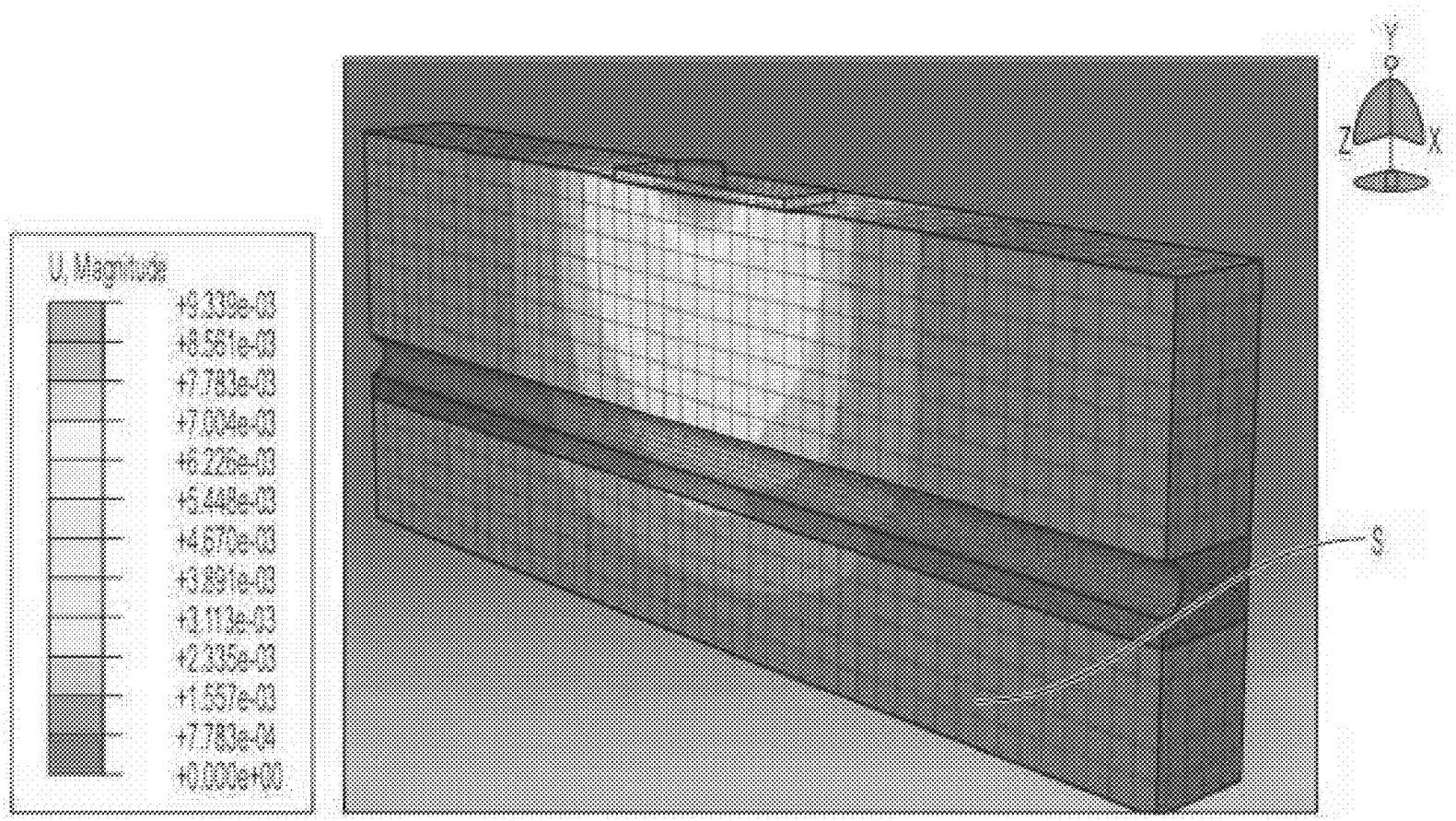
FIGS. 11A and 11B schematically depict finite element analysis of soil and of a pipe for use with the conventional manhole of FIG. 6, respectively, in use.
Figure 11B:
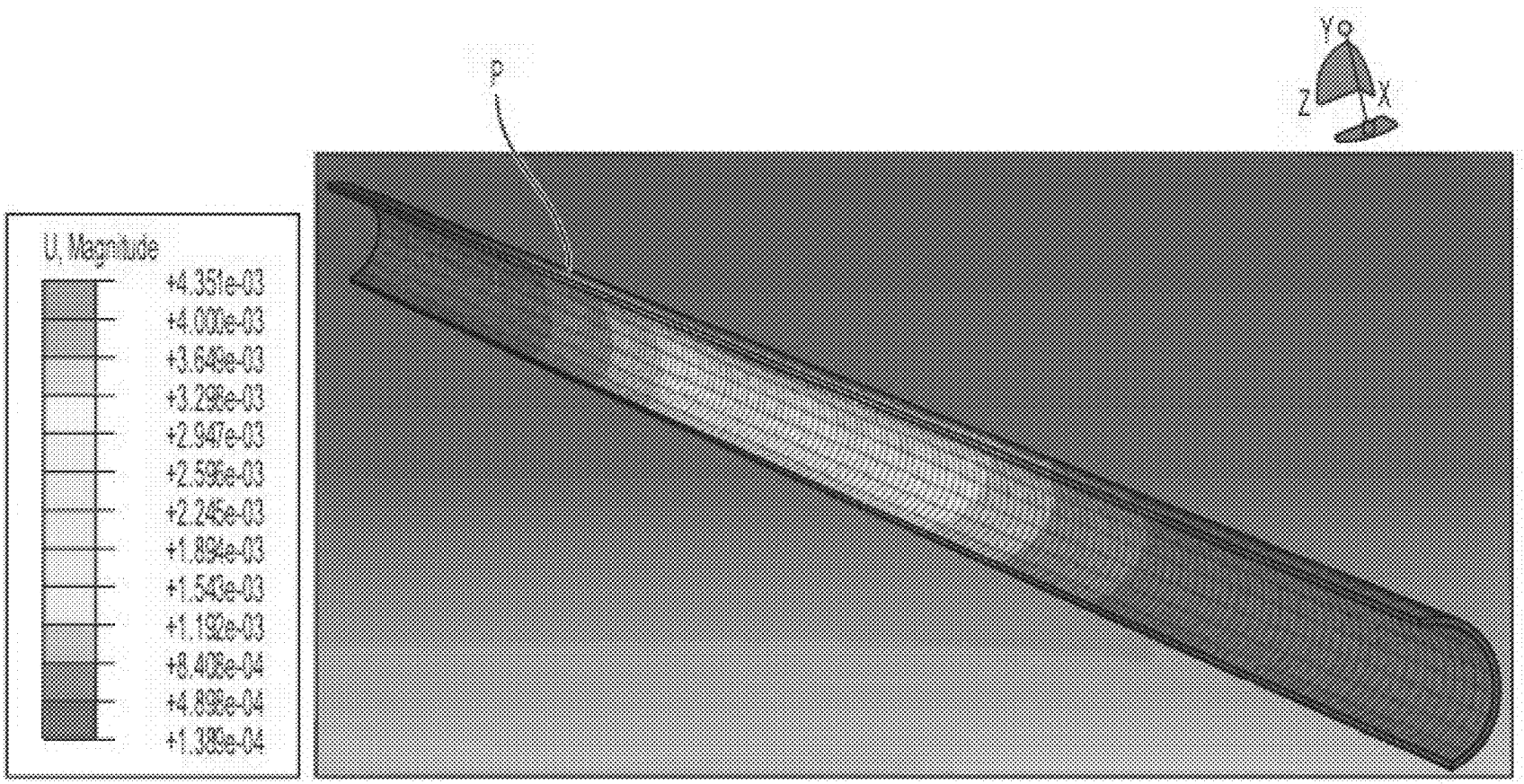
Figure 12A:
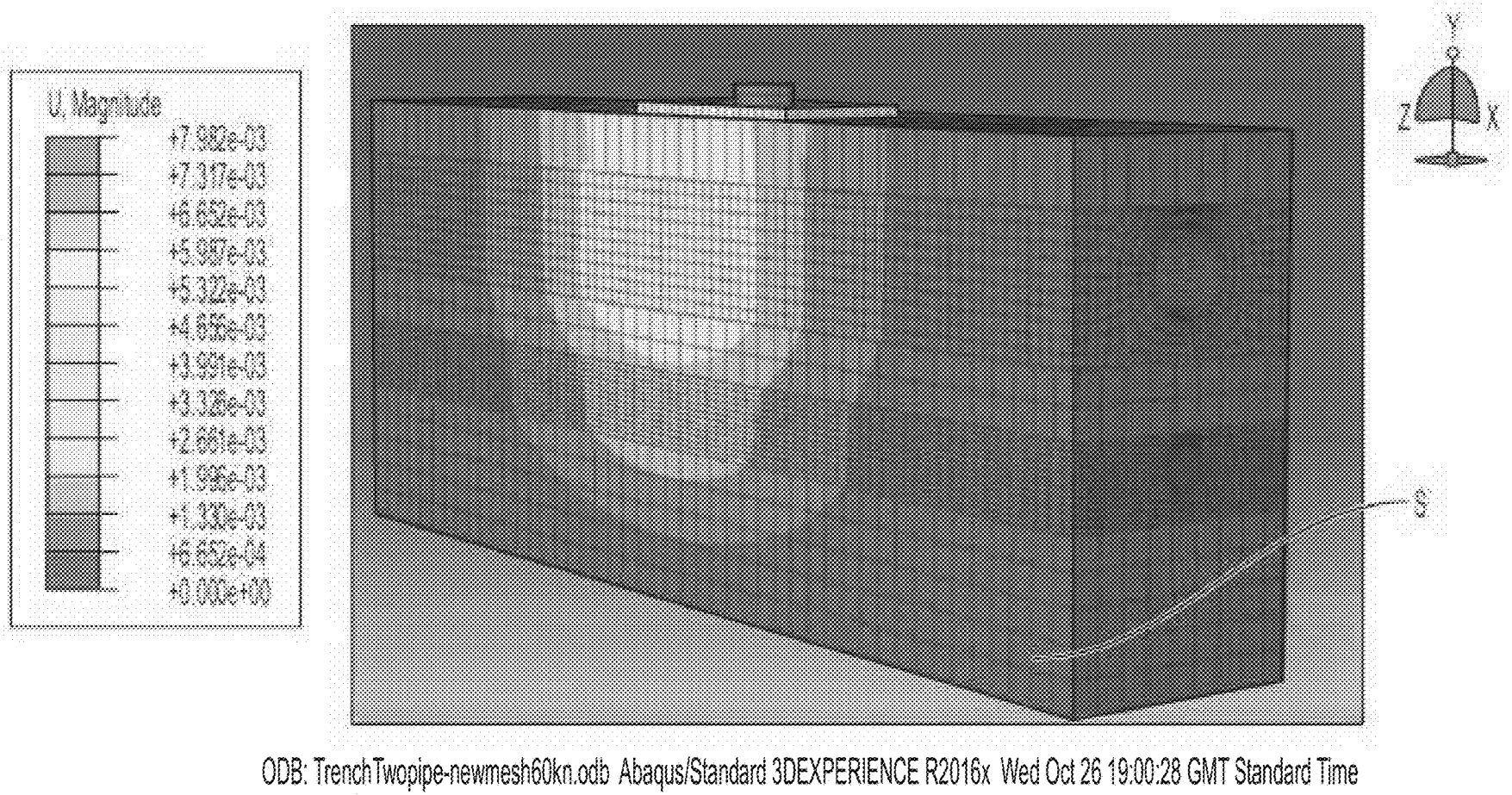
FIGS. 12A and 12B schematically depict finite element analysis of soil and of an arrangement of pipes for use with the manhole of FIG. 1A, respectively, in use.
Figure 12B:
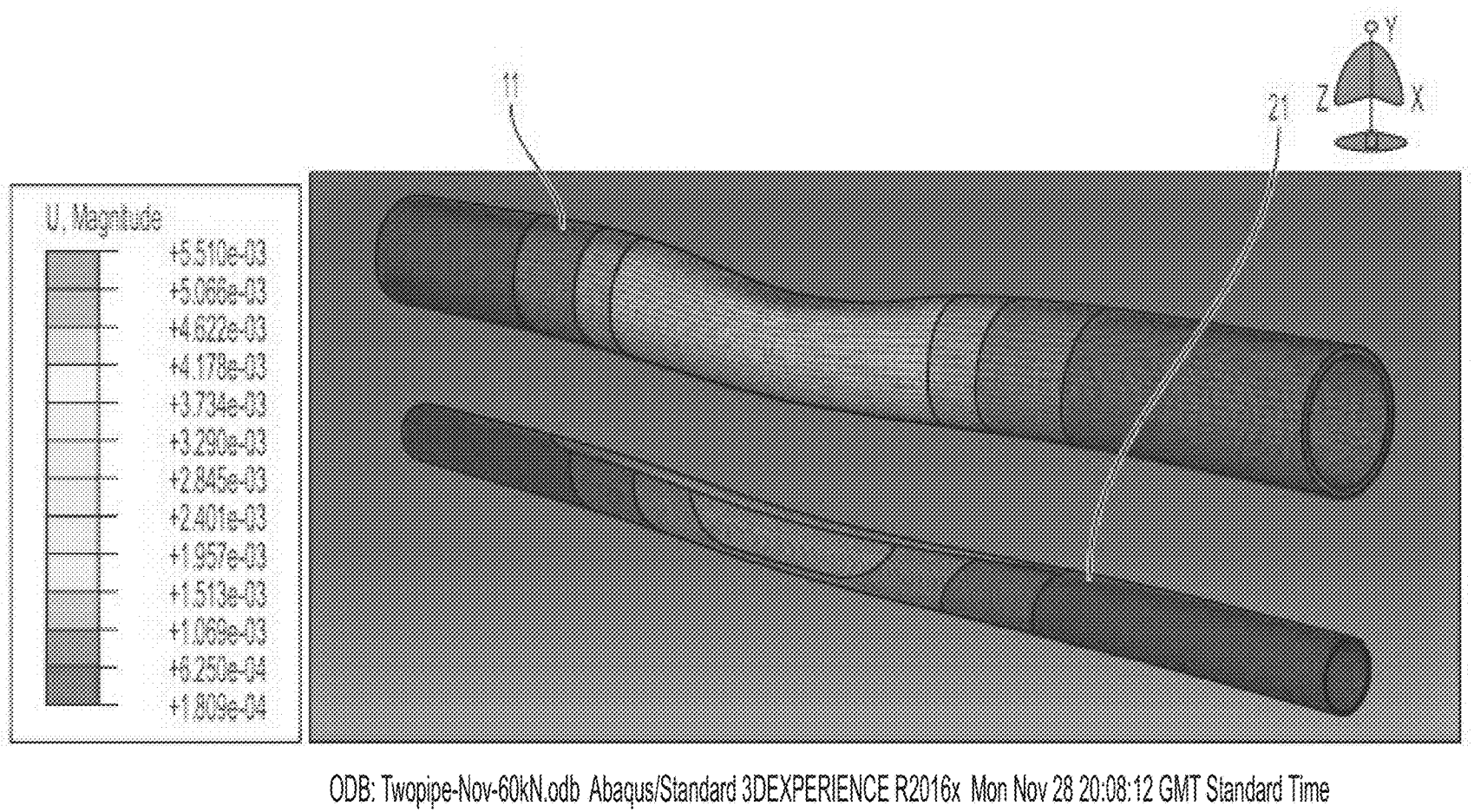

Two PVC pipes were used in this study to establish the behaviour of buried pipe in two different situations. The first was the traditional case where a sanitary pipe is laid alone in soil, this representing the normal combined sewer system, or separate sewer system (i.e. conventional), where pipes are buried in soil according to standard design criteria (FIGS. 11A and 11B). The second case is the according to an embodiment of the invention, two pipes in the trench, the storm pipe on the top and the sanitary pipe below. They are approximately 15 cm apart, separated vertically by filling soil and the bedding layer for the storm pipe (FIGS. 12A and 12B). The traffic load applied in this test, H-20 loading, simulated a highway load of a 20-ton truck.

FIGS. 11A and 11B schematically depict FEA of soil S and a pipe P for use with the conventional manhole M of FIG. 6, respectively, in use. Particularly, FIGS. 11A and 11B show FEA, performed using ABAQUS, of soil S surrounding the pipe P for use with the conventional manhole M, according to a 3 dimensional (3D) model. Displacement or settlement of the soil S and hence deformation of the pipe P is due to an applied load of 0.108 $N/mm^2$, to simulate usage. A maximum deformation of the pipe P and soil S underneath of approximately 4.4 mm is observed.

FIGS. 12A and 12B schematically depict FEA of soil S and of an arrangement of pipes 11 and 12 for use with the manhole 100 of FIG. 1, in use. Particularly, FIGS. 12A and 12B show FEA, performed using ABAQUS, of soil S surrounding the superposed first inlet pipe 11 and the second inlet pipe 21 for use with the manhole 100, according to a 3 dimensional (3D) model. Displacement or settlement of the soil S and hence deformation of the first inlet pipe 11 and the second inlet pipe 21 is due to an applied load of 0.108 $N/mm^2$ (MPa) to simulate usage. A maximum displacement of the first inlet pipe 11 and soil S underneath and the second inlet pipe 21 and soil underneath of approximately 5.5 mm and 3.2 mm m are observed, respectively.

Figure 13:
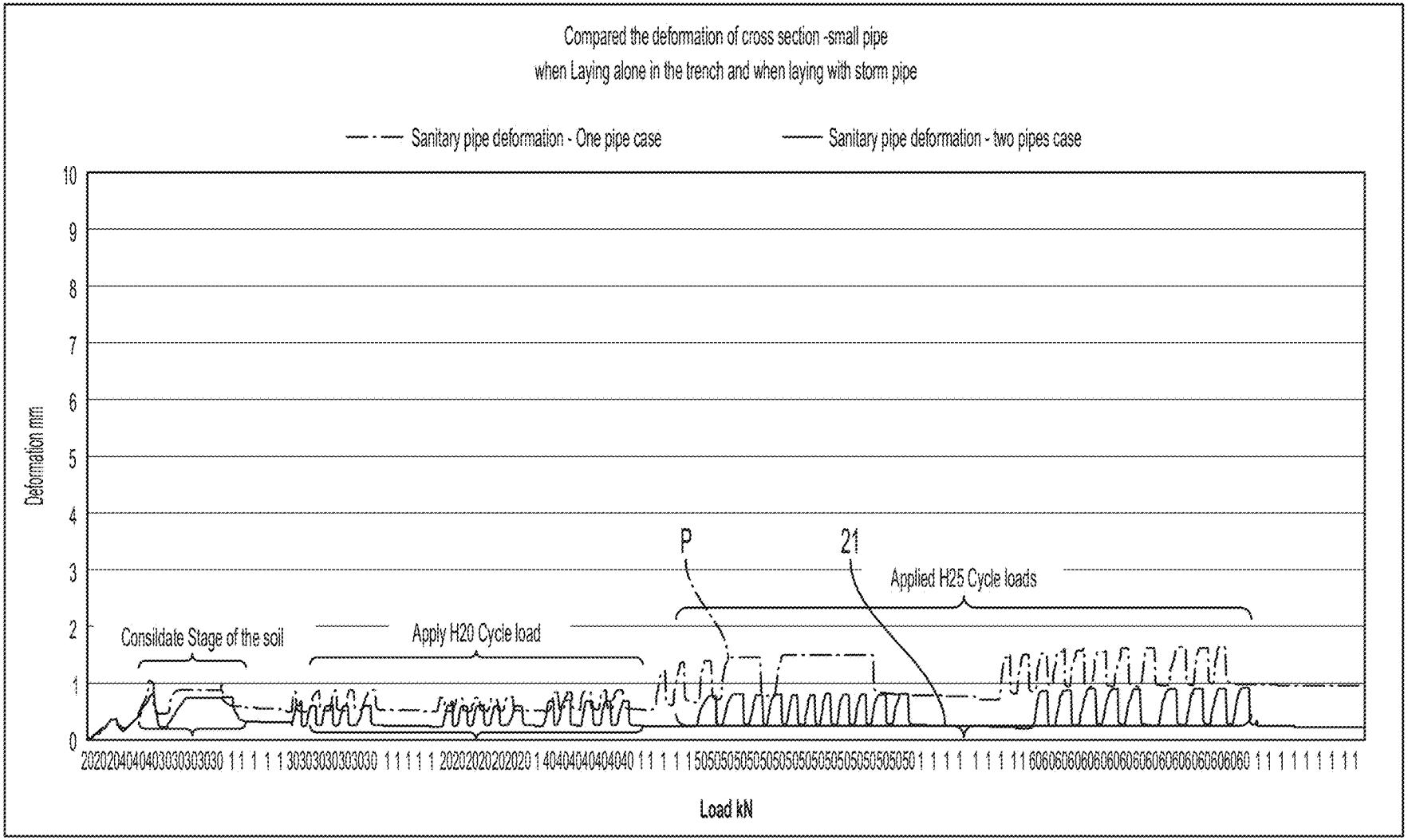
FIG. 13 schematically depicts graphs of deformation of the pipe of FIG. 11B and the arrangement of pipes of FIG. 12B, respectively, in use.

FIG. 13 schematically depicts graphs of deformation of the pipe P of FIG. 11B and the arrangement of pipes of FIG. 12B, respectively, in use. Particularly, FIG. 13 compares deformation of the pipe P of FIG. 11B and the second inlet pipe 21 of the arrangement of pipes of FIG. 12B. Loading of the pipes included a consolidation stage of the soil, followed by H20 cycled loading and then H25 cycled loading. As shown in FIG. 13, deformation of the second inlet pipe 21 is approximately half that of the pipe P, during H25 cycled loading.

Figure 14A:
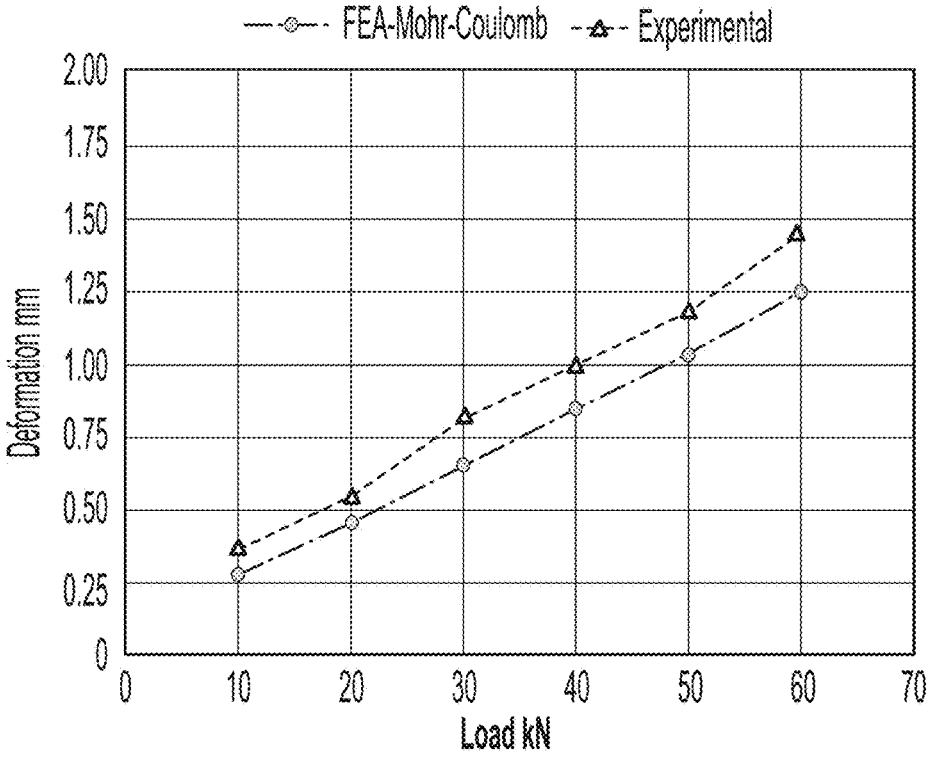
FIG. 14A schematically depicts graphs of deformation of the pipe of FIG. 11B and determined experimentally for a pipe for use with the conventional manhole, respectively, in use.

FIG. 14A schematically depicts graphs of deformation of the pipe P of FIG. 11B and determined experimentally for a pipe P for use with the conventional manhole, respectively, in use. That is, the results of the FEA and the experimental analysis are compared, with good correlation.

Figure 14B:
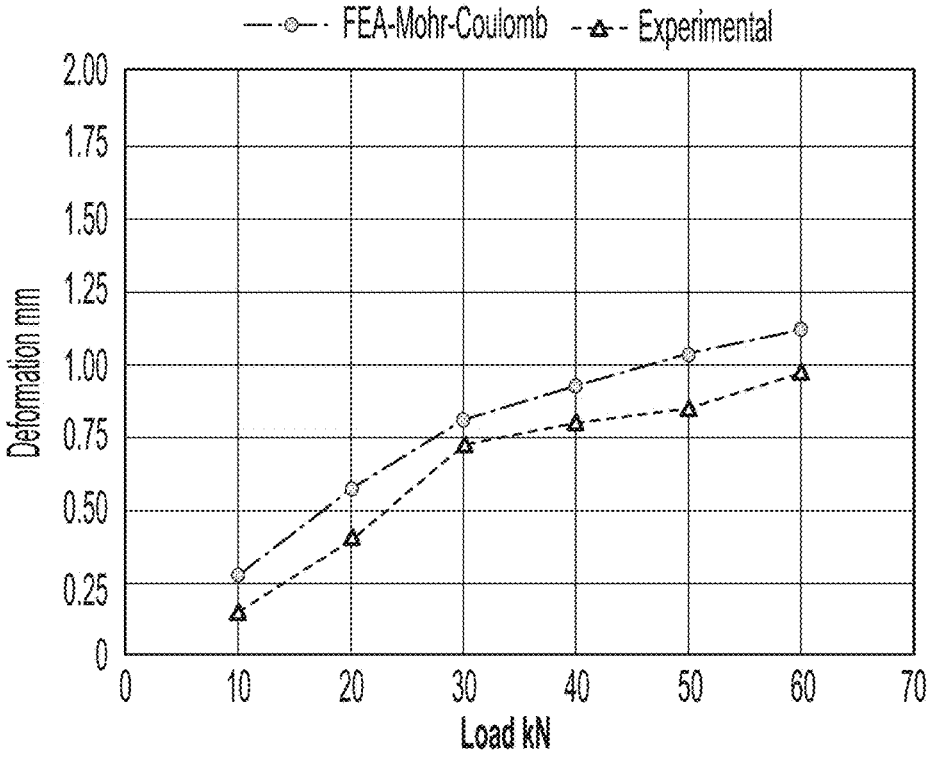
FIG. 14B schematically depicts graphs of deformation of the pipe of FIG. 12B and determined experimentally for an arrangement of pipes for use with the manhole of FIG. 1A, respectively, in use.

FIG. 14B schematically depicts graphs of deformation of the pipe of FIG. 12B and of determined experimentally for arrangement of pipes for use with the manhole of FIG. 1, respectively, in use. That is, the results of the FEA and the experimental analysis are compared, with good correlation. Furthermore, the deformation of the second inlet pipe 21 of the arrangement of pipes of FIG. 12B is significantly lower than for the pipe P for the same loading.

In other words, there are no significant differences between the experimental results and mathematical results regarding deformation of the pipes. The new method (two pipes) has facilitated a reduction in strain from 1.4 mm in the first case (FIG. 14A), to 1 mm in the second case (FIG. 14B). In both cases, the deformation is still within the design criteria limitation, approximately 3% from the diameter of the pipe. The composite structure of the system improved the capacity of this unit to adsorb dynamic loads for example, traffic loads thus protecting the pipe system from failure.

In this way, arranging the first inlet pipe 11 and the second inlet pipe 21 superposed in one trench mitigates deformation and settlement when compared with the pipe P buried under the same conditions. Particularly, deformation in the lower second inlet pipe 21 is about 2 times less under the same load. In other words, setting two pipes in one trench seems to mitigate deformation and settlement when compared with one pipe buried under the same conditions. These results were validated through the physical model in the lab after identifying the correct properties for the soil and pipe material.

Figure 15:
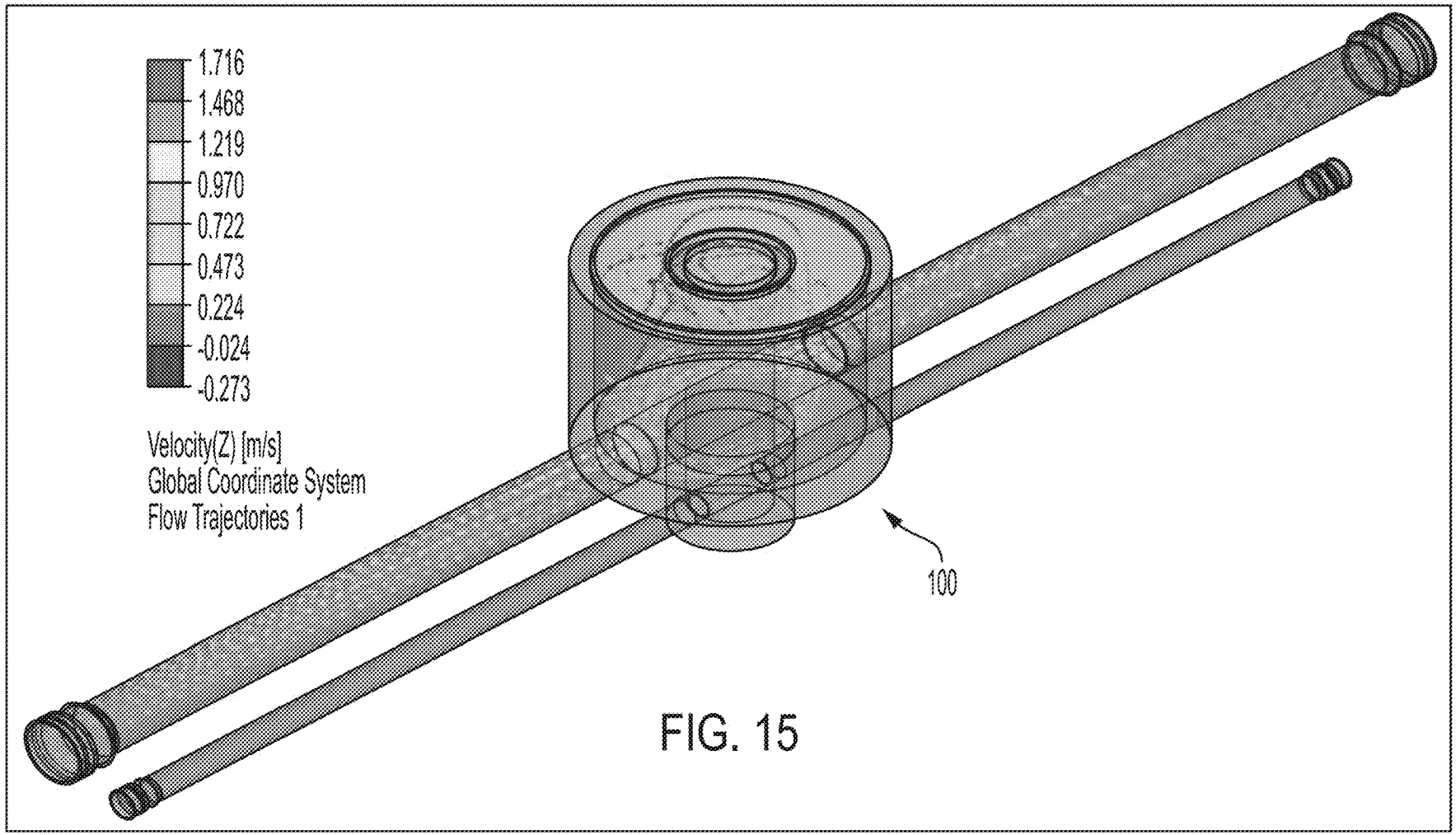
FIG. 15 schematically depicts computational fluid dynamics analysis of flow of water through the manhole of FIG. 1A, in use.
Figure 16:
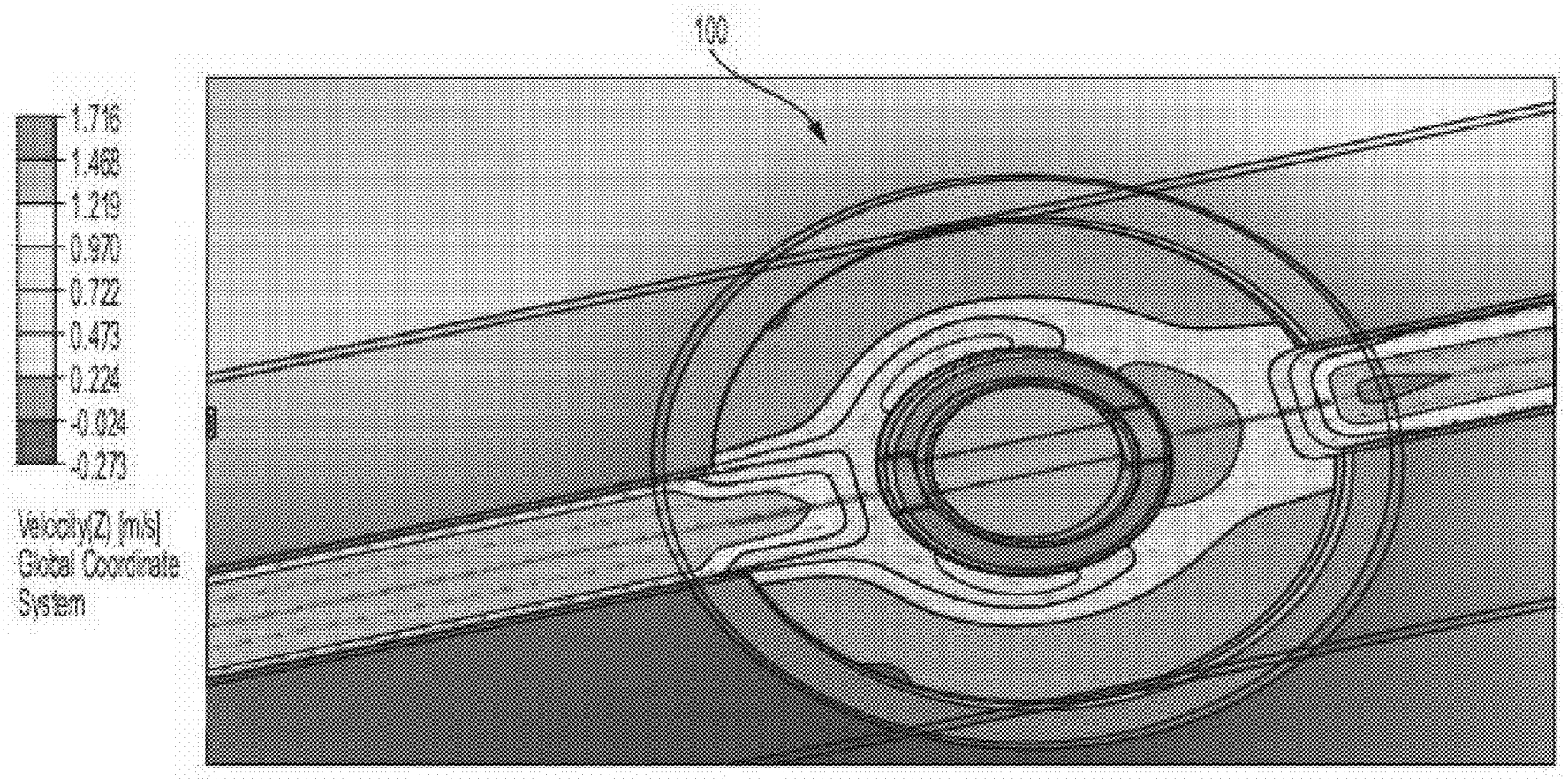
FIG. 16 schematically depicts computational fluid dynamics analysis of flow of water through the manhole of FIG. 1A, in use.

FIGS. 15 and 16 schematically depict computational fluid dynamics (CFD) analysis of flow of water through the manhole 100 of FIG. 1, in use.

Particularly, hydraulic properties (capacity, flow, velocity, depth and head losses, retention time) of the manhole 100 were simulated by CFD using SOLIDWORKS®. The results of velocity, as an example, showed that an area inside the storm manhole (i.e. the first chamber 110) has a small velocity of flow, and it is expected that some settling will happen in this area unless the design and slope of the basic ground is modified. The physical model helps to figure out the dead velocity zone inside the storm manhole and design criteria and gradient of storm manhole base will be determined to get the optimum slope for the storm manhole base to prevent any settlement within the manhole zone.

Figure 17:
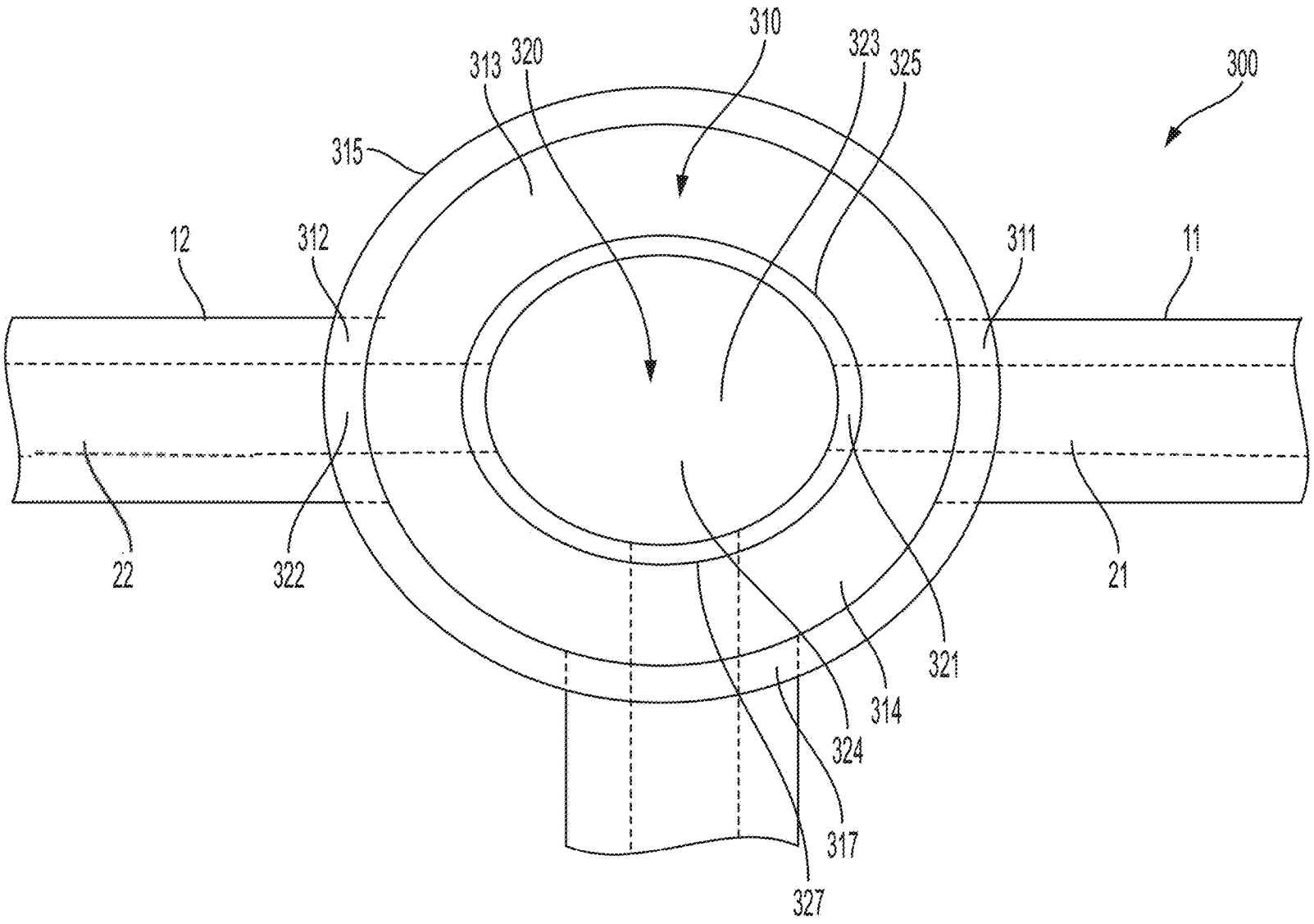
FIG. 17 schematically depicts a plan view of a manhole according to another exemplary embodiment of the invention, in use.
Figure 18:
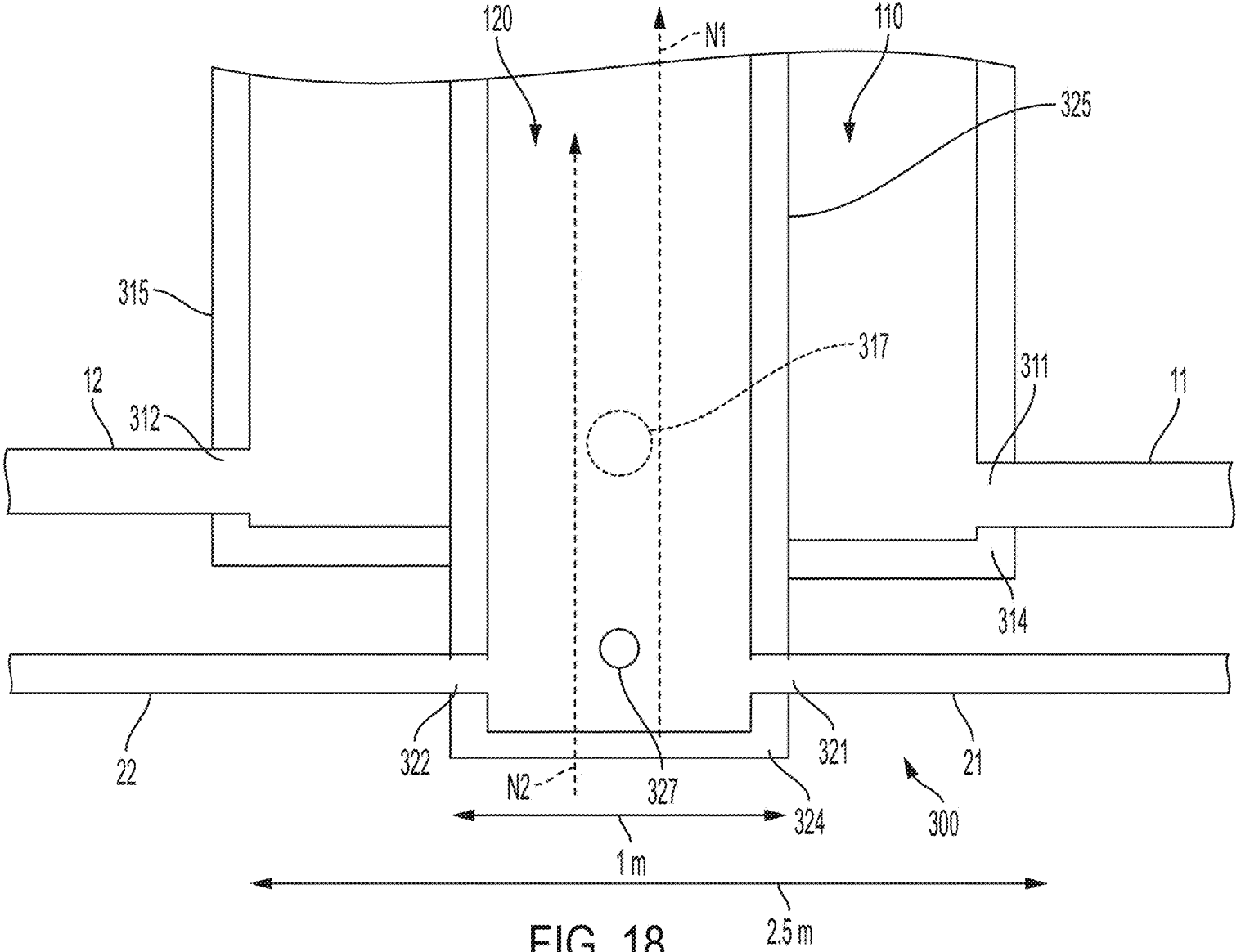
FIG. 18 schematically depicts a side elevation view of the manhole of FIG. 3, in use.

FIG. 17 schematically depicts a plan view of a manhole 300 according to another exemplary embodiment of the invention, in use. FIG. 18 schematically depicts a side elevation view of the manhole 300 of FIG. 18, in use. Like numerals of the manhole 300 denote like features of the manhole 100. Generally, the manhole 300 is as described with respect to the manhole 100. The manhole 300 includes additional inlets, as described below.

The manhole 300 comprises a first chamber 310 arranged to receive storm water and a second chamber 320 arranged to receive sewage water. The first chamber 310 comprises a first inlet 311 and a first outlet 312. The second chamber 320 comprises a second inlet 321 and a second outlet 322. The first chamber 310 comprises a first access port 313 opposed to a first base 314 and a first wall 315 arranged therebetween. The second chamber 320 comprises a second access port 323 opposed to a second base 324 and a second wall 325 arranged therebetween. A first normal N1 to the first base 314 extends through the first base 314 and the second base 324.

A second normal N2 to the second base 324 extends through the second base 324 and the first base 314. The first chamber 310 and the second chamber 320 are superposed. The first chamber 310 and the second chamber 320 are arranged coaxially. The second chamber 320 is arranged at least partly within the first chamber 310. The second chamber 320 extends at least partly through the first chamber 310. The first inlet 311 and the second inlet 321 are aligned about the first normal N1. The first outlet 312 and the second outlet 322 are aligned about the first normal N2. The first inlet 311 is opposed to the first outlet 312. The first wall 315 comprises a cylindrical wall. The second wall 325 comprises a cylindrical wall. The first chamber 310 and the second chamber 320 are arranged concentrically. The first inlet 311 and the first outlet 312 are arranged through the first wall 315. The second inlet 321 and the second outlet 322 are arranged through the second wall 325.

The first chamber 310 comprises another first inlet 317. The second chamber 320 comprises another second inlet 327. The another first inlet 317 and the another second inlet 327 are aligned about the first normal N1. The another first inlet 317 is arranged through the first wall 315. The another second inlet is arranged through the second wall 325. The another first inlet 317 is arranged transverse to the first inlet 311 and the first outlet 312. The another second inlet 327 is arranged transverse to the first inlet 321 and the first outlet 322.

Figure 19:
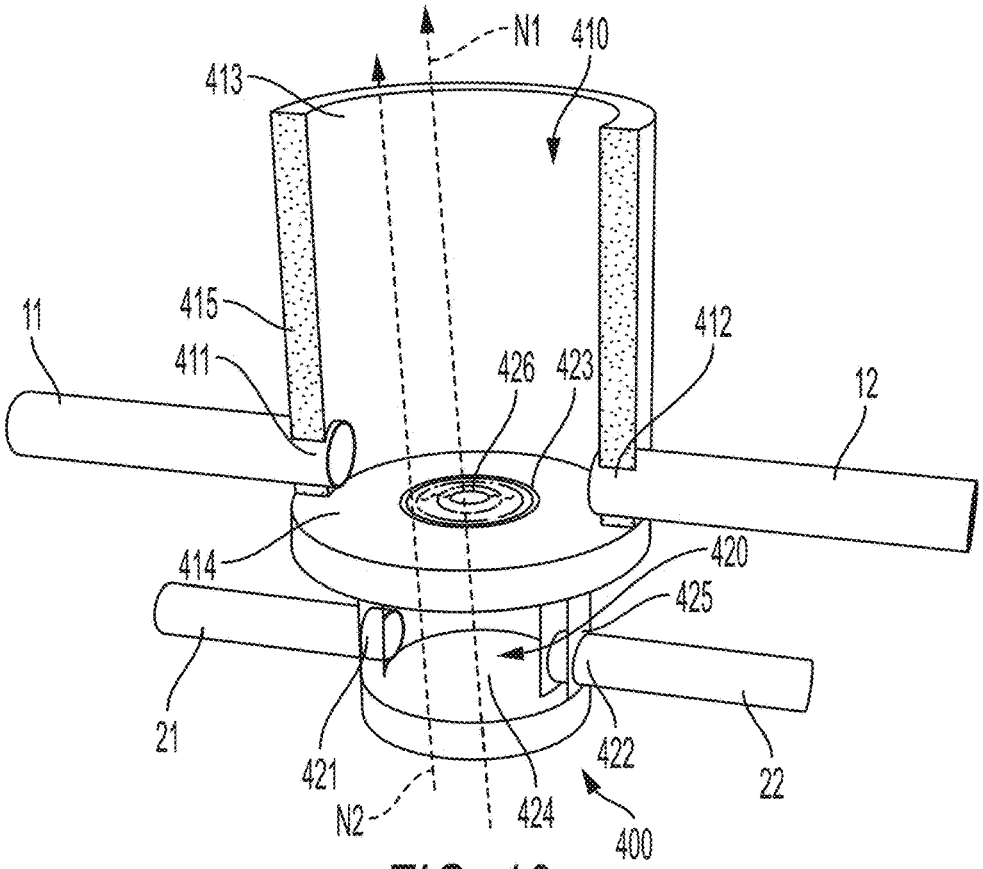
FIG. 19 schematically depicts a cutaway orthographic projection of a manhole according to yet another exemplary embodiment of the invention.

FIG. 19 schematically depicts a cutaway orthographic projection of a manhole 400 according to yet another exemplary embodiment of the invention. Like numerals of the manhole 400 denote like features of the manhole 100. Generally, the manhole 400 is as described with respect to the manhole 100. However, in contrast to the manhole 100, a second access port 423 is accessed via a first chamber 410.

The manhole 400 comprises the first chamber 410 arranged to receive storm water and a second chamber 420 arranged to receive sewage water. The first chamber 410 comprises a first inlet 411 and a first outlet 412. The second chamber 420 comprises a second inlet 421 and a second outlet 422. The first chamber 410 comprises a first access port 413 opposed to a first base 414 and a first wall 415 arranged therebetween. The second chamber 420 comprises the second access port 423 opposed to a second base 424 and a second wall 425 arranged therebetween. A first normal N1 to the first base 414 extends through the first base 414 and the second base 424.

A second normal N2 to the second base 424 extends through the second base 424 and the first base 414. The first chamber 410 and the second chamber 420 are superposed. The first chamber 410 and the second chamber 420 are arranged coaxially. The second chamber 420 is arranged at least partly within the first chamber 410. The second chamber 420 does not extend at least partly through the first chamber 410. The first inlet 411 and the second inlet 421 are aligned about the first normal N1. The first outlet 412 and the second outlet 422 are aligned about the first normal N2. The first inlet 411 is opposed to the first outlet 412. The second access port 423 is accessed via the first chamber 410. The second access port 423 is arranged in the first base 414. The first wall 415 comprises a cylindrical wall. The second wall 425 comprises a cylindrical wall. The first chamber 410 and the second chamber 420 are arranged concentrically. The first inlet 411 and the first outlet 412 are arranged through the first wall 415. The second inlet 421 and the second outlet 422 are arranged through the second wall 425. The second chamber 420 comprises a second cover 426, arrangeable to close the second access port 423.

Figure 20:
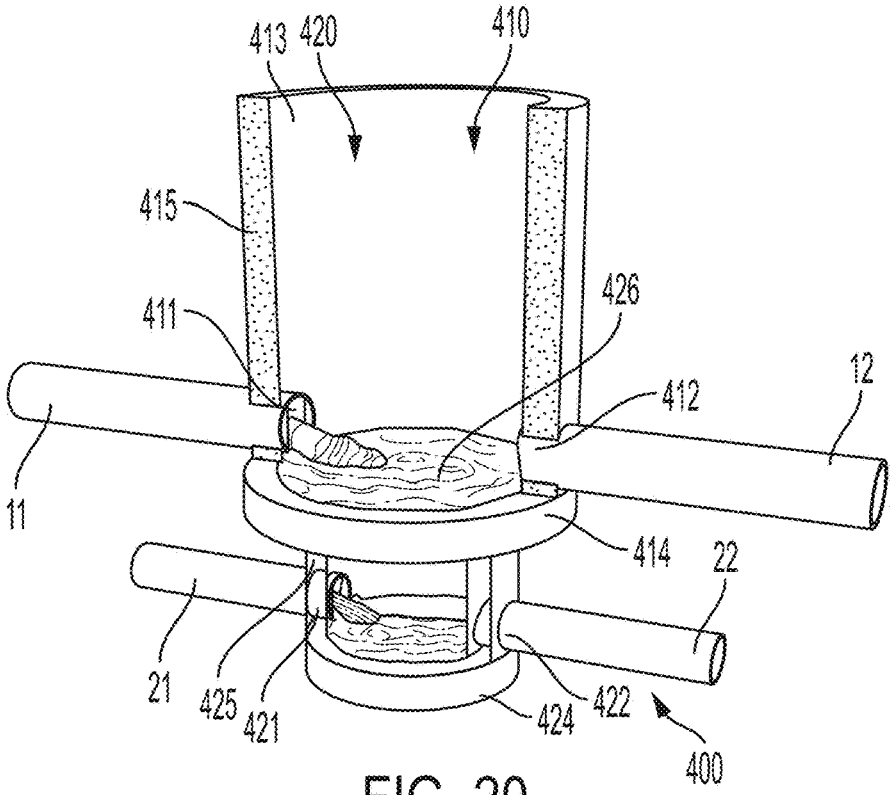
FIG. 20 schematically depicts a cutaway orthographic projection of the manhole of FIG. 19, in use.

FIG. 20 schematically depicts a cutaway orthographic projection of the manhole of FIG. 20, in use. In use, the storm water flows from the first inlet 411 to the first outlet 412 via the first chamber 410, across or over the first base 414 and the second cover 416 arranged in the first base 414. In use, the sewage water flows from the second inlet 421 to the second outlet 422 via the second chamber 420, across or over the second base 424.

Figure 21:
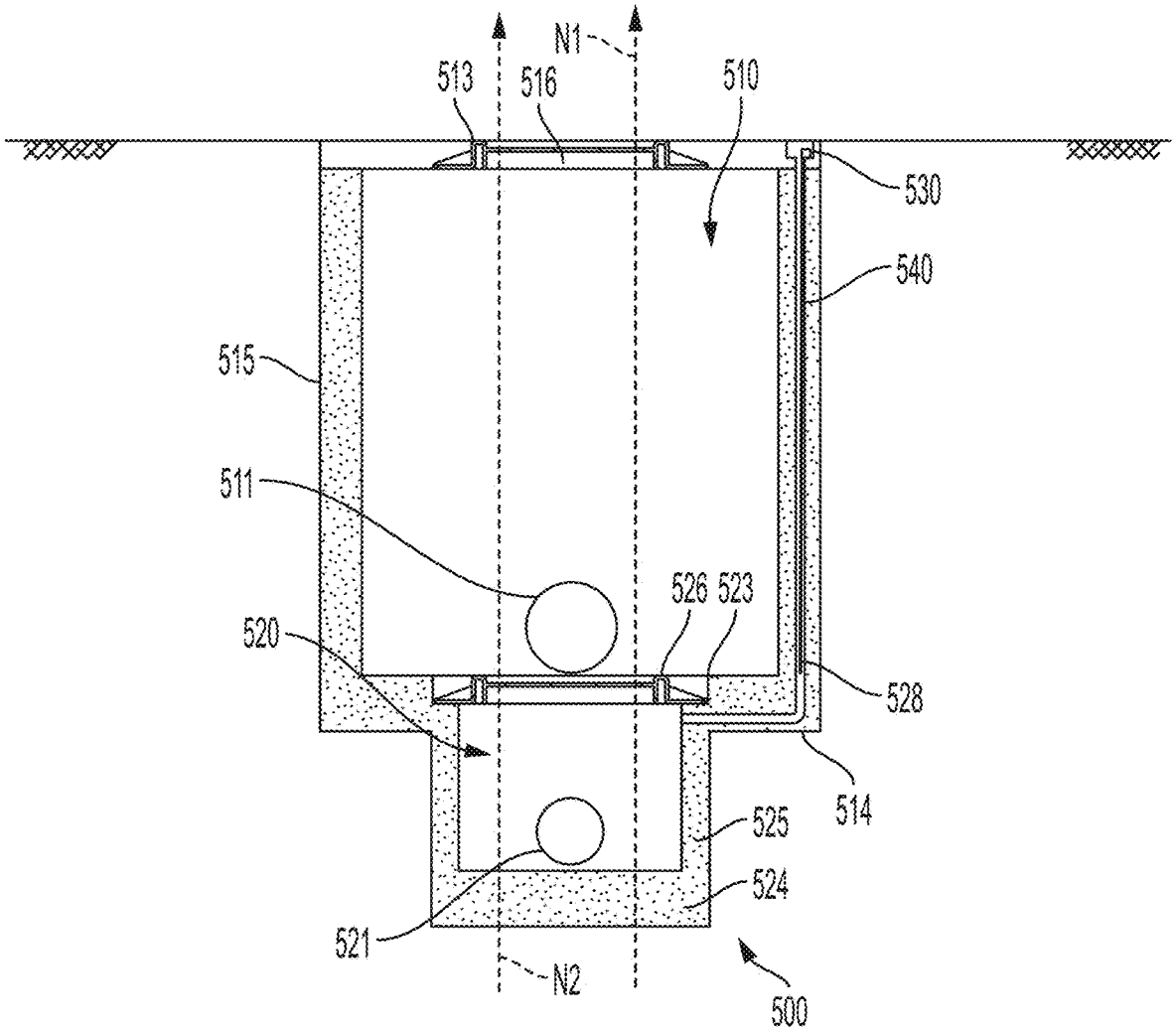
FIG. 21 schematically depicts a cross section of a manhole according to still yet another exemplary embodiment of the invention.

FIG. 21 schematically depicts a cross section of a manhole 500 according to still yet another exemplary embodiment of the invention. Like numerals of the manhole 500 denote like features of the manhole 100. Generally, the manhole 500 is as described with respect to the manhole 100. The manhole 500 includes a second sensor 528, a transmitter 530 and a vent 540, as described below.

The manhole 500 comprises a first chamber 510 arranged to receive storm water and a second chamber 520 arranged to receive sewage water. The first chamber 510 comprises a first inlet 511 and a first outlet. The second chamber 520 comprises a second inlet 521 and a second outlet. The first chamber 510 comprises a first access port 513 opposed to a first base 514 and a first wall 515 arranged therebetween. The second chamber 520 comprises a second access port 523 opposed to a second base 524 and a second wall 525 arranged therebetween. A first normal N1 to the first base 514 extends through the first base 514 and the second base 524.

A second normal N2 to the second base 524 extends through the second base 524 and the first base 514. The first chamber 510 and the second chamber 520 are superposed. The first chamber 510 and the second chamber 520 are arranged coaxially. The second chamber 520 is arranged at least partly within the first chamber 510. The second chamber 520 does not extend at least partly through the first chamber 510. The first inlet 511 and the second inlet 521 are aligned about the first normal N1. The first outlet 512 and the second outlet 522 are aligned about the first normal N2. The first inlet 511 is opposed to the first outlet 512. The second access port 523 is accessed via the first chamber 510. The second access port 523 is arranged in the first base 514. The first wall 515 comprises a cylindrical wall. The second wall 525 comprises a cylindrical wall. The first chamber 510 and the second chamber 520 are arranged concentrically. The first inlet 511 and the first outlet 512 are arranged through the first wall 515. The second inlet 521 and the second outlet 522 are arranged through the second wall 525. The first chamber 510 comprises a first cover 516, arrangeable to close the first access port 513. The second chamber 520 comprises a second cover 526, arrangeable to close the second access port 523.

The manhole comprises the second sensor 528 arranged to measure a level of the sewage water in the second chamber 520. In this way, the level of the sewage water in the second chamber 520 may be sensed. The manhole 500 comprises the transmitter 530 arranged to transmit a signal, for example an overflow signal, a warning signal or an alarm signal, according to the sensed water level. In this way, the sensed water level may be received remotely and appropriate action may be taken, for example inspection and/or maintenance.

The manhole 500 comprises the vent 540, for example, a passageway or a conduit arranged between the second chamber 520 and the surface of the ground G. The vent 540 comprises a 2 inch PVC pipe provided within the first wall 515, the first base 514 and through the second wall 525 into the second chamber 520. The second sensor 528 is arranged in the vent 540. The transmitter 530 is arranged in the vent 540 proximal the surface of the ground G.

Figure 22:
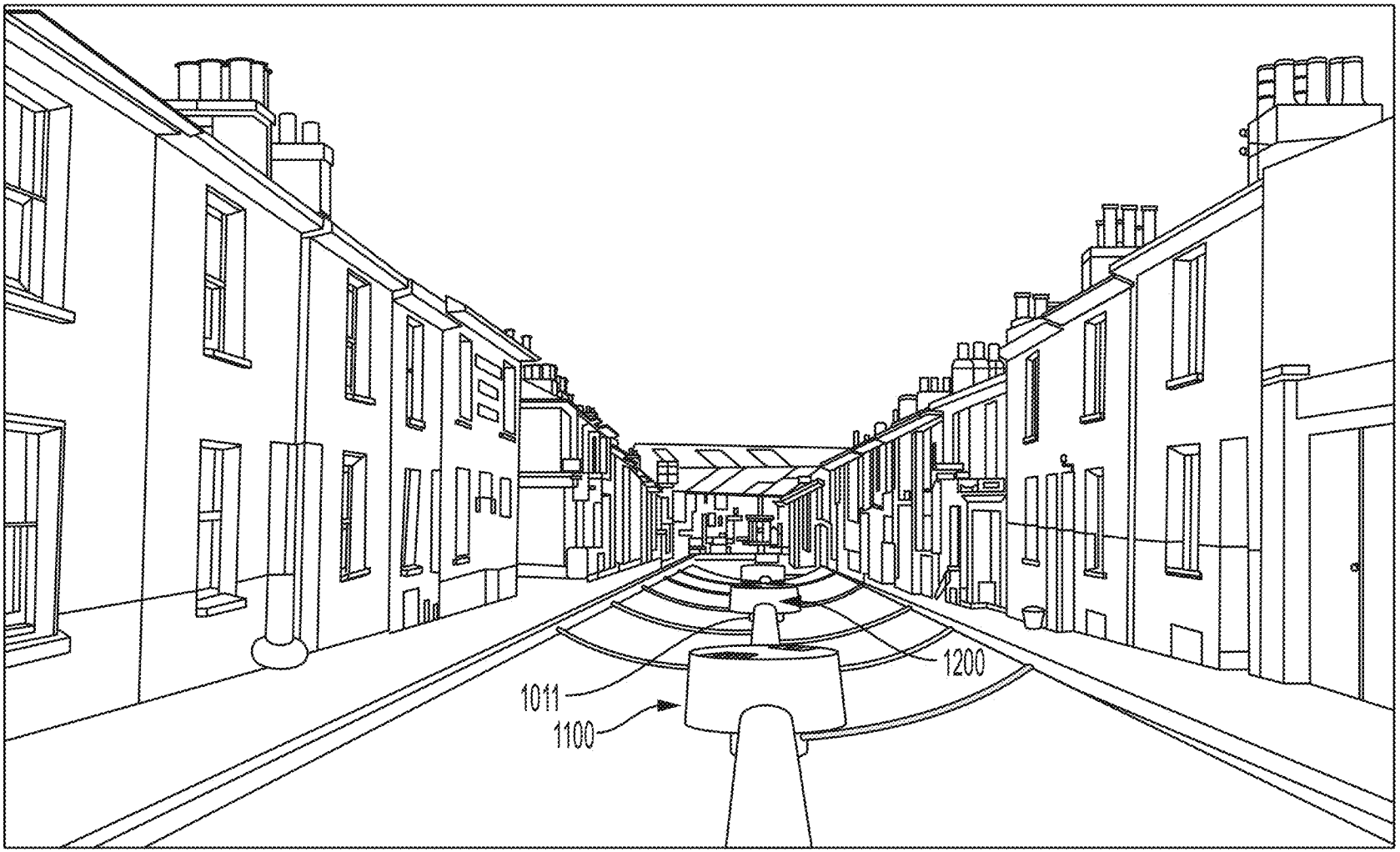
FIG. 22 schematically depicts a perspective view of a sewer network according to an exemplary embodiment of the invention.

FIG. 22 schematically depicts a perspective cutaway view of a sewer network 1000 according to an exemplary embodiment of the invention. Particularly, the sewer network 1000 is installed under an existing street. The UK and most other European countries usually have narrow streets, occupied by a complex network of infrastructure services such as potable water, electricity, communication and gas lines. Finding a space in which to place another two sets of pipes (in a conventional separate sewer system) is a challenge, but the sewer network 1000 is capable of overcoming this challenge.

The network comprises a first manhole 1100 according to the first aspect, a second manhole 1200 according to the first aspect, and a first pipe 1011 and a second pipe 1012 (not shown) extending therebetween. The first pipe 1011 is coupled to the first outlet 1112 (not shown) of the first manhole 1100 and to the first inlet 1211 (not shown) of the second manhole 1200. The second pipe 1012 (not shown) is coupled to the second outlet 1122 (not shown) of the first manhole 1100 and to the second inlet 1221 (not shown) of the second manhole 1200. The first pipe 1011 and the second pipe 1012 (not shown) are superposed for at least a part of their respective lengths. The first pipe 1011 and the second pipe 1012 (not shown) are superposed for their respective lengths, the first pipe 1011 being arranged above the second pipe 1012 (not shown).

Figure 23:
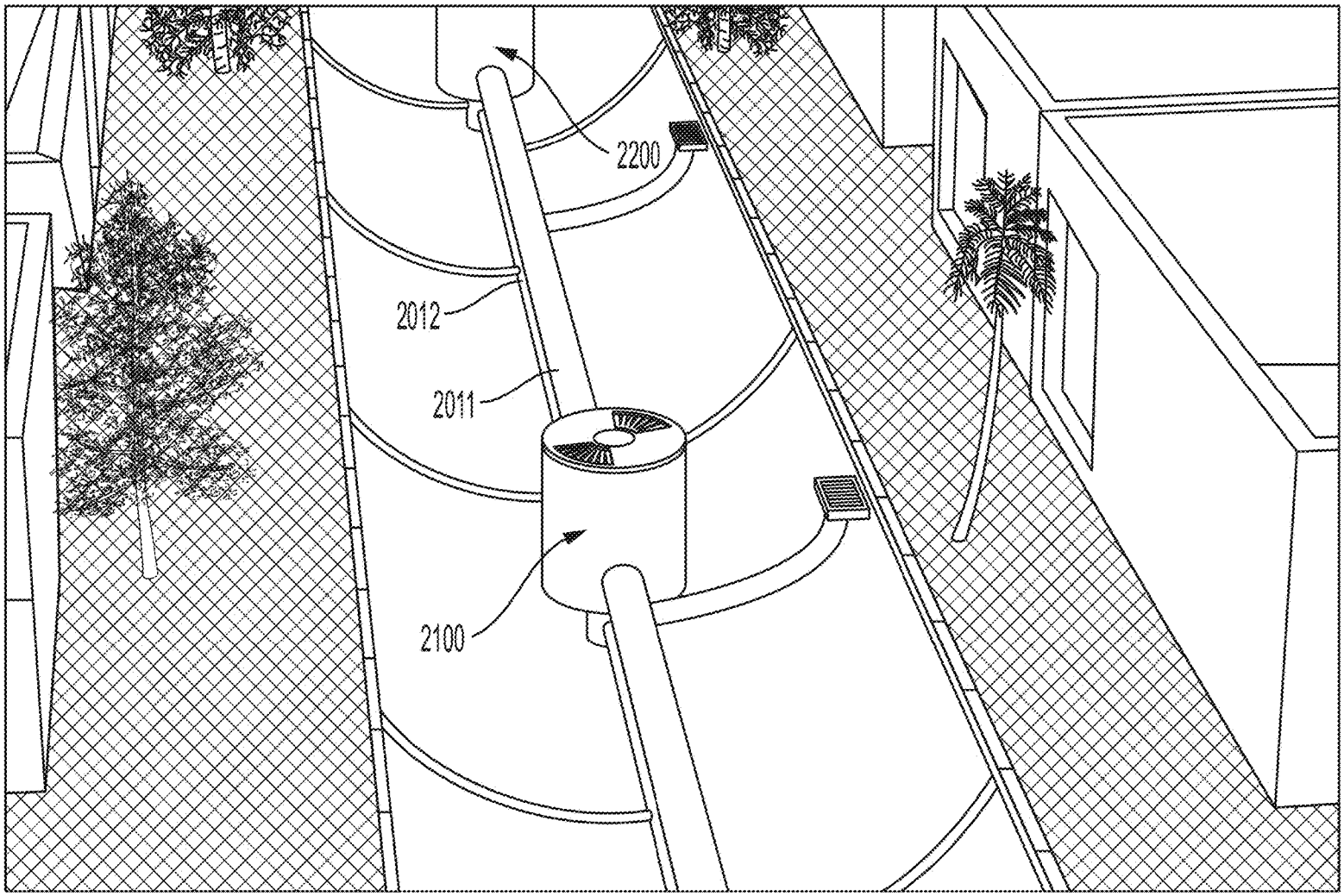
FIG. 23 schematically depicts a perspective view of another sewer network according to an exemplary embodiment of the invention.

FIG. 23 schematically depicts a perspective cutaway view of another sewer network 2000 according to an exemplary embodiment of the invention. Particularly, the sewer network 2000 is installed under a new street.

The network comprises a first manhole 2100 according to the first aspect, a second manhole 2200 according to the first aspect, and a first pipe 2011 and a second pipe 2012 extending therebetween. The first pipe 2011 is coupled to the first outlet 2112 (not shown) of the first manhole 2100 and to the first inlet 2211 (not shown) of the second manhole 2200. The second pipe 2012 is coupled to the second outlet 2122 (not shown) of the first manhole 2100 and to the second inlet 2221 (not shown) of the second manhole 2200. The first pipe 2011 and the second pipe 2012 are superposed for at least a part of their respective lengths. The first pipe 2011 and the second pipe 2012 are superposed for their respective lengths, the first pipe 2011 being arranged above the second pipe 2012.

Figure 24:
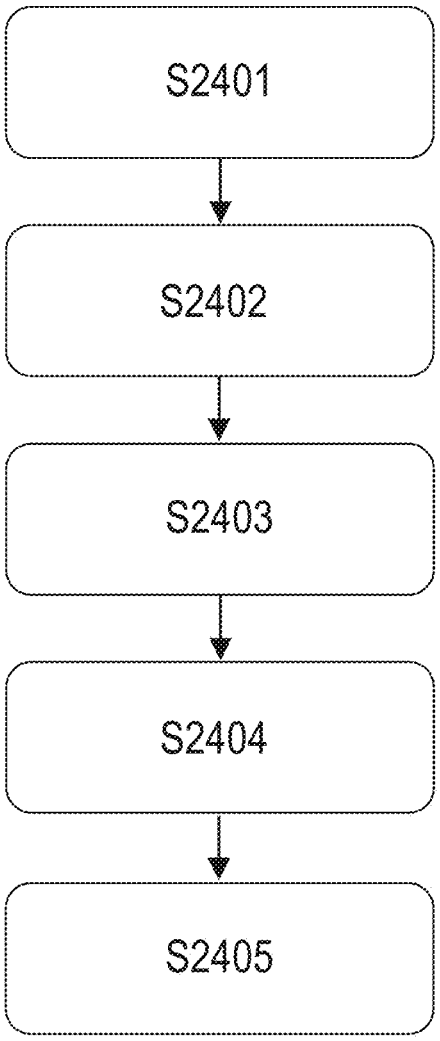
FIG. 24 schematically depicts a method of installing a sewer network according to an exemplary embodiment of the invention.

FIG. 24 schematically depicts a method of installing a sewer network according to an exemplary embodiment of the invention, wherein the sewer network is according the first aspect.

At S2401, an excavation arranged to receive the first manhole, the second manhole and the first pipe and the second pipe extending therebetween is provided.

At S2402, the first manhole, the second manhole and the first pipe and the second pipe extending therebetween are arranged in the excavation.

At S2403, the first pipe is coupled to the first outlet of the first manhole and to the first inlet of the second manhole.

At S2404, the second pipe is coupled to the second outlet of the first manhole and to the second inlet of the second manhole, wherein the first pipe and the second pipe are superposed for at least the part of their respective lengths.

At S2405, the excavation is backfilled.

In summary, the invention provides a manhole, a sewer network and a method of installing a sewer network. The manhole may maintain sewage water and storm water separately, thereby better avoid mixing of the sewage water and storm water. In this way, the capacity requirements of the treatments plants may be reduced compared with conventional combined sewer networks while diversion of sewage water by CSOs is avoided. In this way, contamination of the watercourses is avoided. Since the sewage water and the storm water may be maintained separate in the same manhole, the manhole and/networks comprising the manhole be associated with lower costs and/or reduced installation requirements compared with conventional separate sewer networks, allowing installation in narrow streets, for example. By superposing first and second pipes in the sewer network, deformation of the pipes may be reduced, thereby reducing failure of the pipes.

A comparison between using the sewer network as described herein and a conventional sewer network shows that the sewer network as described herein may be expected to decrease an initial cost by about 10% to 20% and may reduce a construction time by 40%. In addition, using the sewer network as described herein, a reduction in earthworks by about 40% as a result of using one trench for the two separate pipes (storm pipe and sanitary pipe) is estimated. The sewer network as described herein is expected to decrease an installation footprint by about 15% to 20% and may give a margin of space for other utilities, especially in narrow streets. The sewer network as described herein may improve an hydraulic integrity of storm networks significantly. The sewer network as described herein is expected to increase storage capacity by 250% compared with conventional sewer networks and increase a retention time for storm water flow inside the storm network by 200% compared with a storm flow retention time of conventional networks. Improving the hydraulic properties of the storm networks increase the safety factor of the design against flooding.

Furthermore, the sewer network as described herein may be used to improve existing combined sewer networks by adding the external chamber (i.e. the first chamber for example a storm chamber) to the existing manholes used in the existing combined networks, and installing pipes for storm water above the combined pipe which will use only for the sewage flow. This method is promising to solve the combined sewer system in the narrow streets prevalent in UK and EU cities.

This sewer network as described herein may be used for installation of a separate sewer network in all new developments.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims and drawings), and/or all of the steps of any method or process so disclosed, may be combined in any combination, except combinations where at least some of such features and/or steps are mutually exclusive.

Each feature disclosed in this specification (including any accompanying claims, and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims and drawings), or to any novel one, or any novel combination, of the steps of any method or process so disclosed.

The invention claimed is:

1. A manhole for subterranean installation, the manhole comprising:

a first chamber arranged to transport storm water and comprising a first inlet and a first outlet, the storm water being received into the first chamber via the first inlet and being discharged from the first chamber via the first outlet; and a second chamber arranged to transport sewage water and comprising a second inlet and a second outlet, the sewage water being received into the second chamber via the second inlet and being discharged from the second chamber via the second outlet;

wherein:

the first chamber and the second chamber are separate chambers fluidly disconnected from one another, such that the storm water and the sewage water do not mix during transport through the first and second chambers, respectively;

the first chamber comprises a first access port opposed to a first base and a first wall arranged therebetween;

the second chamber comprises a second access port opposed to a second base and a second wall arranged therebetween;

a first normal to the first base extends through the first base and the second base;

the first normal extends through a first region defined by a first perimeter of the first base, the first perimeter being defined by an intersection of the first base and the first wall; and the first access port and the second access port each lie in a single plane, the single plane being substantially perpendicular to the first normal.

2. The manhole according to claim 1, wherein:

a second normal to the second base extends through the second base and the first base, the second normal extends through a second region defined by a second perimeter of the second base, and the second perimeter is defined by an intersection of the second base and the second wall.

3. The manhole according to claim 1, wherein the single plane is further coplanar with a plane defined by a surface of the ground.

4. The manhole according to claim 1, wherein at least one of:

the first chamber and the second chamber are superposed, or the first base and the second base are arranged in different planes.

5. The manhole according to claim 1, wherein the first chamber and the second chamber are arranged coaxially.

6. The manhole according to claim 5, wherein the first chamber surrounds the second chamber coaxially.

7. The manhole according to claim 1, wherein at least one of:

the second chamber is arranged at least partly within the first chamber, or the second chamber extends at least partly through the first chamber.

8. The manhole according to claim 1, wherein at least one of:

the first inlet is opposed to the first outlet, or the second inlet is opposed to the second outlet.

9. The manhole according to claim 1, wherein at least one of:

the first wall comprises a cylindrical wall, or the second wall comprises a cylindrical wall.

10. The manhole according to claim 9, wherein the first chamber and the second chamber are arranged concentrically.

11. The manhole according to claim 10, wherein the first chamber is toroidal and the second chamber is cylindrical, the second chamber extending at least partly through a passageway defined by the toroidal first chamber.

12. The manhole according to claim 1, wherein the second wall of the second chamber separates the second chamber from the first chamber.

13. A sewer network for transporting storm water and sewage water separately, the network comprising:

a first manhole and a second manhole, each according to claim 1; and a first pipe and a second pipe each extending between the first manhole and the second manhole;

wherein:

the first pipe is coupled to a first outlet of the first manhole and to a first inlet of the second manhole;

the second pipe is coupled to a second outlet of the first manhole and to a second inlet of the second manhole; and the first pipe and the second pipe are superposed for at least a part of lengths of the first pipe and the second pipe, respectively.

14. A method of installing a sewer network according to claim 13, the method comprising the steps of:

providing an excavation arranged to receive the first manhole, the second manhole, and the first pipe and the second pipe extending therebetween;

arranging the first manhole, the second manhole and the first pipe and the second pipe extending therebetween in the excavation, wherein the first pipe and the second pipe are superposed for at least the part corresponding with the lengths of the first pipe and the second pipe, respectively;

coupling the first pipe to the first outlet of the first manhole and to the first inlet of the second manhole;

coupling the second pipe to the second outlet of the first manhole and to the second inlet of the second manhole; and backfilling the excavation.

15. The method according to claim 14, wherein:

a first chamber of the first manhole is toroidal and a second chamber of the first manhole is cylindrical, the second chamber extending at least partly through a passageway defined by the first chamber;

the second chamber of the first manhole is an existing second chamber in the excavation; and the step of arranging the first manhole in the excavation comprises arranging the first chamber of the first manhole around the existing second chamber.

16. The manhole according to claim 2, wherein:

the first perimeter defines a first diameter of the first chamber;

the second perimeter defines a second diameter of the second chamber; and the first diameter is greater than the second diameter such that the first chamber surrounds the second chamber.

17. The manhole according to claim 16, wherein the first chamber and the second chamber are arranged coaxially and the first chamber surrounds the second chamber coaxially.

18. The manhole according to claim 1, wherein:

the second chamber is defined, in part, by a second diameter; and the first chamber is defined, in part, by a first diameter, the first diameter being greater than the second diameter such that the first chamber surrounds the second chamber coaxially.

19. The manhole according to claim 1, wherein:

the first base lies in a second plane parallel with the first plane;

the second base lies in a third plane parallel with the second plane; and the second plane is positioned intermediate the first and third planes.

20. The manhole according to claim 1, wherein:

the first base lies in a second plane;

the second base lies in a third plane parallel with the second plane; and the second plane is positioned closer to the first plane than the third plane is positioned relative to the first plane.

* * * * *